US008875798B2

(12) United States Patent
Van Winkle

(10) Patent No.: US 8,875,798 B2
(45) Date of Patent: Nov. 4, 2014

(54) WELLSITE REPLACEMENT SYSTEM AND METHOD FOR USING SAME

(75) Inventor: Denzal Wayne Van Winkle, Santa Mana, CA (US)

(73) Assignee: National Oilwell Varco, L.P., Houston, TX (US)

( * ) Notice: Subject to any disclaimer, the term of this patent is extended or adjusted under 35 U.S.C. 154(b) by 881 days.

(21) Appl. No.: 12/761,550

(22) Filed: Apr. 16, 2010

(65) Prior Publication Data

US 2010/0270746 A1 Oct. 28, 2010

Related U.S. Application Data

(60) Provisional application No. 61/172,907, filed on Apr. 27, 2009.

(51) Int. Cl.

| | |
|---|---|
| ***E21B 33/035*** | (2006.01) |
| ***E21B 33/076*** | (2006.01) |
| *E21B 33/064* | (2006.01) |
| *E21B 33/08* | (2006.01) |

(52) U.S. Cl.

CPC ..... *E21B 33/076* (2013.01); *E21B 33/064* (2013.01); *E21B 33/08* (2013.01)

USPC ..... 166/387; 166/85.3; 166/339; 277/323; 137/315.02

(58) Field of Classification Search

USPC ..... 166/338, 340, 341, 344, 360, 365, 367, 166/368, 277, 377, 378, 379, 381, 387, 166/85.1, 85.3, 339, 85.4, 84.1, 84.2, 84.3, 166/84.4; 277/323, 327–330, 344; 137/315.02

See application file for complete search history.

(56) References Cited

U.S. PATENT DOCUMENTS

| | | | | |
|---|---|---|---|---|
| 1,997,152 | A * | 4/1935 | Penick et al. | 277/323 |
| 3,463,226 | A * | 8/1969 | Johnson | 166/351 |
| 3,561,723 | A | 2/1971 | Cugini | |
| 3,583,480 | A * | 6/1971 | Regan | 166/352 |
| 3,662,823 | A * | 5/1972 | Murman et al. | 166/338 |
| 3,717,000 | A * | 2/1973 | Rothwell, Jr. | 405/190 |
| 3,741,295 | A * | 6/1973 | Murman et al. | 166/338 |
| 3,741,296 | A | 6/1973 | Murman et al. | |

(Continued)

FOREIGN PATENT DOCUMENTS

| | | |
|---|---|---|
| EP | 1061231 | 12/2000 |

OTHER PUBLICATIONS

Schlumberger Oilfield Glossary entry for "stripping", accessed Feb. 8, 2013 via www.glossary.oilfield.slb.com.*

(Continued)

*Primary Examiner* — Black Michener
(74) *Attorney, Agent, or Firm* — JL Salazar Law Firm

(57) ABSTRACT

Systems and methods for replacing equipment at a wellsite, the wellsite having a subsea stripper installed proximate a subsea borehole. The system has at least one seal assembly portion, at least one seal replacement arm and an actuator. The seal assembly portion(s) is (are) positionable in the subsea stripper and replaceable therefrom. The seal assembly portion(s) has (have) a packer extendable within the subsea stripper to form a seal about the subsea stripper. The seal replacement arm(s) is (are) for replacing the seal assembly portion(s) through a door of the subsea stripper. The actuator is for remotely actuating the seal replacement arm(s) to engage the seal assembly portion(s) whereby the seal assembly portion(s) is (are) remotely replaceable.

18 Claims, 26 Drawing Sheets

(56) References Cited

U.S. PATENT DOCUMENTS

| | | | | | |
|---|---|---|---|---|---|
| 4,003,430 | A | * | 1/1977 | Carnahan | 166/85.3 |
| 4,133,342 | A | * | 1/1979 | Carnahan | 137/315.02 |
| 4,220,206 | A | | 9/1980 | Van Winkle | |
| 4,262,748 | A | | 4/1981 | Kirkland | |
| 4,392,633 | A | | 7/1983 | Van Winkle | |
| 4,416,441 | A | | 11/1983 | Van Winkle | |
| 4,646,825 | A | | 3/1987 | Van Winkle | |
| 4,648,782 | A | * | 3/1987 | Kraft | 414/735 |
| 4,690,033 | A | | 9/1987 | Van Winkle | |
| 4,690,411 | A | | 9/1987 | Van Winkle | |
| 4,813,495 | A | | 3/1989 | Leach | |
| 4,899,823 | A | | 2/1990 | Cobb et al. | |
| 4,923,005 | A | * | 5/1990 | Laky et al. | 166/55 |
| 4,943,031 | A | | 7/1990 | Van Winkle | |
| 4,986,360 | A | | 1/1991 | Laky et al. | |
| 5,505,426 | A | | 4/1996 | Whitby et al. | |
| 5,515,925 | A | | 5/1996 | Boychuk | |
| 5,566,753 | A | * | 10/1996 | Van Winkle et al. | 166/84.1 |
| 5,735,502 | A | | 4/1998 | Levett et al. | |
| 5,897,094 | A | | 4/1999 | Brugman et al. | |
| 5,961,094 | A | | 10/1999 | Van Winkle | |
| 5,975,484 | A | | 11/1999 | Brugman et al. | |
| 6,006,647 | A | | 12/1999 | Van Winkle | |
| 6,012,528 | A | | 1/2000 | Van Winkle | |
| 6,113,061 | A | | 9/2000 | Van Winkle | |
| 6,164,619 | A | | 12/2000 | Van Winkle et al. | |
| 6,230,824 | B1 | | 5/2001 | Peterman et al. | |
| 6,244,560 | B1 | | 6/2001 | Johnson | |
| 6,321,846 | B1 | | 11/2001 | Rytlewski | |
| 6,364,021 | B1 | * | 4/2002 | Coats | 166/350 |
| 6,439,302 | B1 | * | 8/2002 | Wiedemann | 166/84.4 |
| 6,457,526 | B1 | * | 10/2002 | Dailey | 166/338 |
| 6,484,808 | B2 | * | 11/2002 | Jones et al. | 166/379 |
| 6,742,597 | B2 | | 6/2004 | Van Winkle et al. | |
| 6,857,634 | B2 | | 2/2005 | Araujo | |
| 7,096,960 | B2 | * | 8/2006 | Hemphill et al. | 166/373 |
| 7,114,571 | B2 | | 10/2006 | Gatherar et al. | |
| 7,165,619 | B2 | | 1/2007 | Fox et al. | |
| 7,181,808 | B1 | | 2/2007 | Van Winkle | |
| 7,207,384 | B2 | | 4/2007 | Dallas et al. | |
| 7,431,092 | B2 | | 10/2008 | Haheim et al. | |
| 7,523,644 | B2 | | 4/2009 | Van Winkle | |
| 8,387,701 | B2 | | 3/2013 | Sbordone | |
| 2002/0074131 | A1 | | 6/2002 | Jones et al. | |
| 2003/0079881 | A1 | * | 5/2003 | Moss | 166/339 |
| 2004/0124380 | A1 | | 7/2004 | Van Winkle | |
| 2005/0061499 | A1 | * | 3/2005 | Hopper | 166/84.3 |
| 2005/0077043 | A1 | | 4/2005 | Dallas | |
| 2005/0279494 | A1 | | 12/2005 | Sachdeva et al. | |
| 2006/0076526 | A1 | | 4/2006 | McWhorter et al. | |
| 2007/0051164 | A1 | | 3/2007 | Van Winkle | |
| 2008/0121429 | A1 | | 5/2008 | Bamford | |
| 2008/0185152 | A1 | | 8/2008 | Sbordone et al. | |
| 2008/0185153 | A1 | | 8/2008 | Smedstad et al. | |
| 2008/0277122 | A1 | | 11/2008 | Tinnen | |
| 2009/0050329 | A1 | * | 2/2009 | Johnson et al. | 166/339 |
| 2009/0152817 | A1 | | 6/2009 | Du | |
| 2010/0270746 | A1 | | 10/2010 | Van Winkle | |
| 2011/0315404 | A1 | | 12/2011 | Bailey et al. | |
| 2012/0125622 | A1 | * | 5/2012 | Melancon et al. | 166/339 |
| 2013/0192847 | A1 | | 8/2013 | Bailey et al. | |

OTHER PUBLICATIONS

Dictionary definition of "door", accessed Jul. 18, 2013 via thefreedictionary.com.*

Dictionary definition of "about", accessed on Nov. 20, 2013 via thefreedictionary.com.*

Texas Oil Tools. 4.06"10/15K DSW4/DSW6 2 Door Stripper Packer. Series D Tech Unit D601000258-001/01, Mar. 2008.

PCT Search Report for International Applicaiton No. PCT/US2010/038584 dated Feb. 7, 2011.

Texas Oil Tools, 4.06" 10/15K DSW4/DSW6 2 Door Stripper Packer D Tech Unit D60100258-00/01, Mar. 2008.

Texas Oil Tools. 4.06" 10/15K DSW4/DSW6 2 Door Stripper Packer. Series D Tech Unit D601000258-001/01, Mar. 2008.

Extended European Search Report for Patent Application No. 10160935.2 dated Aug. 27, 2013, 8 pages.

International Preliminary Report on Patentability for PCT Application No. PCT/US2010/038584 dated Jan. 2, 2012.

* cited by examiner

WELLSITE REPLACEMENT SYSTEM AND METHOD FOR USING SAME

CROSS-REFERENCE TO RELATED APPLICATION

This application claims the benefit of U.S. Provisional Application No. 61/172,907, filed Apr. 27, 2009, the entire contents of which are hereby incorporated by reference.

BACKGROUND OF THE INVENTION

The present invention relates generally to techniques for replacing equipment at a wellsite. More specifically, the invention relates to techniques for replacing wellsite equipment, for example, in applications relating to the field of blowout preventers (BOPS) and strippers, and to a device for remotely replacing subsea equipment, such as a worn packer element in a BOP or stripper, used for example in sub-sea applications.

Oilfield operations are typically performed to locate and gather valuable downhole fluids. Oil rigs are positioned at wellsites, and downhole tools, such as drilling tools, are deployed into the ground to reach subsurface reservoirs. Many oilfield operations occur in the sea, or ocean. Subsea oilfield operations typically require the wellhead and other wellsite equipment to be located on the seabed, while an oil platform, or vessel, may be located at the water's surface. The wellsite equipment located at the seabed may comprise such subsea equipment as blow out preventers (BOPs), strippers, control devices, supporting tubing injectors, tubing reels, wireline units, and the like. The stripper may act as a seal that the conveyance, such as coiled tubing, is run through. As the coiled tubing is fed through the stripper, the stripper may seal the outer surface of the coiled tubing, thereby preventing sea water from entering the well, and/or from wellbore fluids from leaving the wellbore inadvertently. The BOP may act as a safety device designed to 'seal in' large pressure surges in the wellbore. The BOP may have rams that automatically shut thereby closing and sealing in the wellbore.

Drilling and work-over operations with the well heads installed under water make it desirable to perform specific repair and maintenance evolutions without bringing the subsea equipment, such as a worn stripper element or an entire blowout preventer (BOP), to the surface. Known methods at depths below safe depths for diver operations require bringing the BOP components, and the stripper components to the surface for refurbishment. Such an operation is typically expensive, time consuming, and results in significant down time for the well being maintained.

In some cases, shallower equipment replacement operations may be performed by a diver. However, as drilling operations take place at ever increasing depths, such techniques become impractical. It is desirable to develop techniques, such as those provided in the following disclosure, to facilitate replacement of worn packer sealing elements, or seal assemblies, and/or replacement of such an element with a different size or having a different function, such as changing from a packer to a slip element. Further, these functions are preferably performed without the aid of a diver.

Attempts have been made to replace components of BOPs as described, for example, in U.S. Pat. Nos. 5,961,094 and 3,741,296. Techniques have also been provided for replacing packers in an undersea application as described, for example in U.S. Pat. Nos. 5,961,094; 6,012,528; and 6,113,061.

Despite the development of techniques for replacing packers and components of BOPs, there remains a need to provide advanced techniques for performing replacement operations. It may be desirable to provide techniques that provide for replacement of various subsea equipment, such as packers, seal assemblies, downhole tools, etc. It may be further desirable that such techniques be performed remotely and/or automatically. Preferably, such techniques involve one or more of the following, among others: efficient replacement, reduced downtime, simpler structure (for example to broaden the application for remotely changing a worn packer element), reduced manning, etc. The present invention is directed to fulfilling this need in the art.

SUMMARY OF THE INVENTION

In at least one aspect, the present invention relates to a replaceable seal assembly portion for a subsea stripper at a wellsite. The subsea stripper may be installed proximate a subsea borehole. The seal assembly portion comprises a carrier operatively connectable within the subsea stripper. The seal assembly portion comprises a packer positionable in the carrier and extendable therefrom. The seal assembly portion comprises bushing(s) for providing support to the packer, the at least one bushing positionable in the carrier adjacent the packer. The seal assembly portion comprises at least one retaining member for connecting the bushing(s) to the carrier whereby the packer is operatively secured to the carrier and extendable therefrom for providing a seal about the subsea stripper.

In another aspect, the present invention relates to a system for replacing equipment at a wellsite. The wellsite has a subsea stripper installed proximate a subsea borehole. The system comprises at least one seal assembly portion positionable in the subsea stripper and replaceable therefrom. The seal assembly portion(s) comprise a packer extendable within the subsea stripper to form a seal thereabout. The system further comprises at least one seal replacement arm for replacing the seal assembly portion(s) through a door of the subsea stripper, and an actuator for remotely actuating the seal replacement arm(s) to engage the seal assembly portion(s) whereby the seal assembly portion(s) are remotely replaceable.

In another aspect, the present invention relates to a method for replacing equipment at a wellsite. The wellsite has a subsea stripper proximate a subsea wellbore. The method comprises opening a door of the subsea stripper, engaging a used seal assembly portion within the stripper by remotely actuating at least one seal replacement arm operatively coupled to the subsea stripper, replacing the used seal assembly portion from the subsea stripper with a new seal assembly portion using the remotely actuated seal replacement arm(s), and closing the door of the subsea stripper.

In some aspects, the present invention provides a split carrier which retains a replacement packer and bushings. A thread is provided on the case of the carrier to facilitate gripping the carrier during the process of changing the packer element. These and other features and advantages of this invention will be readily apparent to those skilled in the art.

BRIEF DESCRIPTION OF THE DRAWINGS

So that the above recited features and advantages of the present invention can be understood in detail, a more particular description of the invention, briefly summarized above, may be had by reference to the embodiments thereof that are illustrated in the appended drawings. It is to be noted, however, that the appended drawings illustrate only typical embodiments of this invention and are, therefore, not to be considered limiting of its scope, for the invention may admit to other equally effective embodiments. The Figures are not necessarily to scale and certain features and certain views of the Figures may be shown exaggerated in scale or in schematic in the interest of clarity and conciseness.

FIG. 2A shows the equipment replacement system in an operating position. FIG. 2B shows the equipment replacement system in a replacement position.

DETAILED DESCRIPTION OF THE INVENTION

The description that follows includes exemplary apparatus, methods, techniques, and instruction sequences that embody techniques of the present inventive subject matter. However, it is understood that the described embodiments may be practiced without these specific details.

Figure 1:
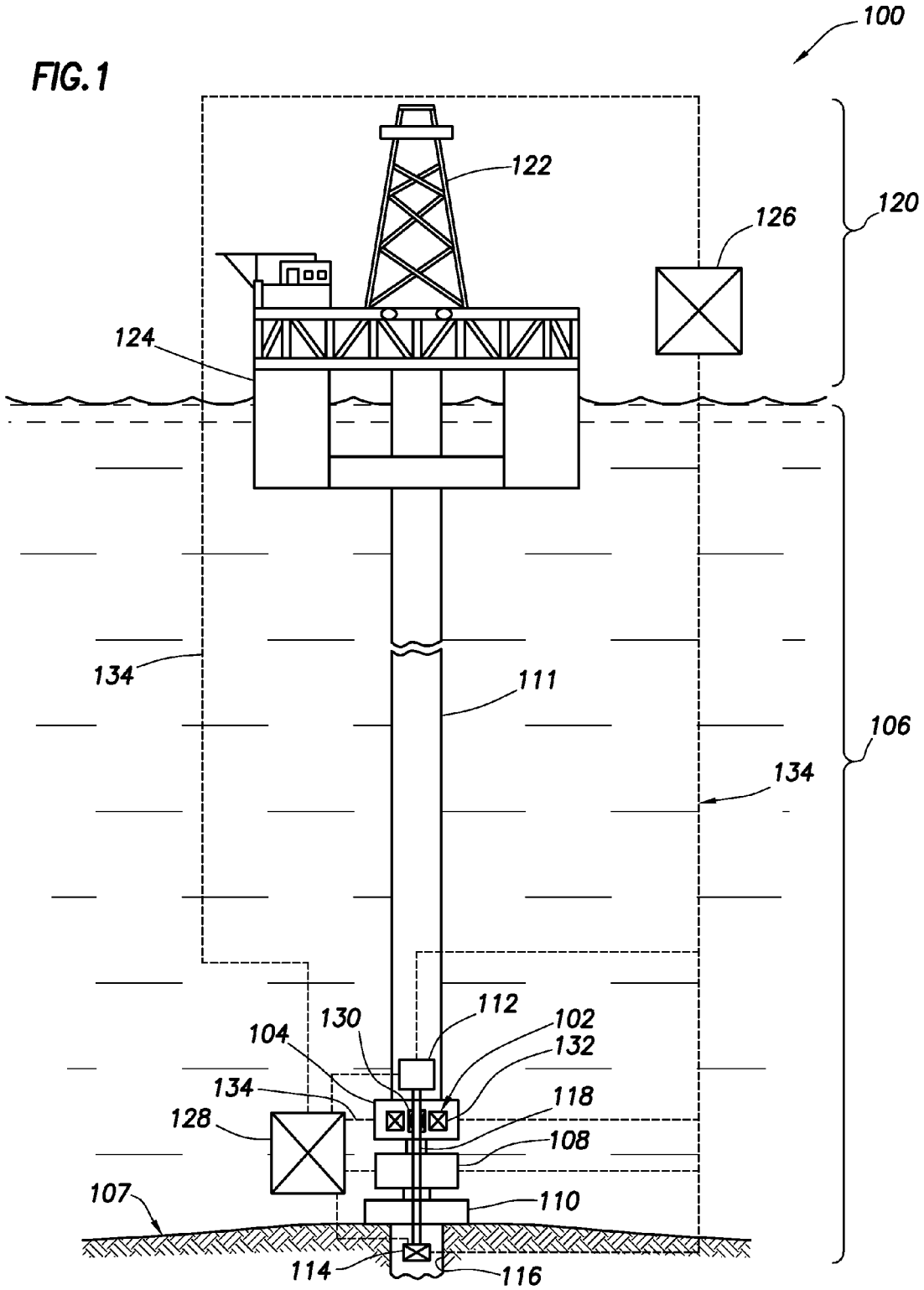
FIG. 1 shows a schematic view of an offshore wellsite having a subsea stripper and including an equipment replacement system.

FIG. 1 depicts an offshore wellsite 100 having an equipment replacement system 102. The equipment replacement system 102 is preferably configured for automatically replacing subsea equipment without the need for removing the equipment using, for example, a remotely operated vehicle (ROV) and/or a diver to replace the equipment. As shown, the equipment replacement system 102 is located within a stripper 104 of a subsea system 106 positioned on seabed 107.

The subsea system 106 may comprise the stripper 104, a blow out preventer (BOP) 108, a wellhead 110, a conduit 111, and a conveyance delivery system 112. The conveyance delivery system 112 may be configured to convey one or more downhole tools 114 into a wellbore 116 on a conveyance 118. Although the equipment replacement system 102 is described as being used in subsea operations, it will be appreciated that the wellsite may be land or water based and the equipment replacement system 102 may be used in any drilling environment. A surface system 120 may be used to facilitate the oilfield operations at the offshore wellsite 100. The surface system 120 may comprise a rig 122, a platform 124 (or vessel) and a controller 126. Further, there may be one or more subsea controllers 128. As shown the controller 126 is at a surface location and the subsea controller 128 is in a subsea location, it will be appreciated that one or more controllers may be located at various locations to control the surface and/or subsea systems.

The conveyance delivery system 112, as shown, is located proximate the subsea equipment, for example the stripper 104 and the BOP 108. The conveyance 118 in one example may be a coiled tubing. The conveyance delivery system 112 may be, for example, a coiled tubing injector. The coiled tubing injector may inject and/or motivate the coiled tubing and/or downhole tool 114 into the wellbore 116 through the subsea system 106. As shown, the conveyance delivery system 112 is located within the conduit 111, although it should be appreciated that it may be located at any suitable location, such as at the sea surface, proximate the subsea equipment, without the conduit 111, and the like. Although the conveyance delivery system 112 is described as being a coiled tubing injector, it should be appreciated that the conveyance delivery system 112 may be any suitable device for conveying the conveyance 118 through the subsea equipment and into the wellbore. Further, the conveyance 118 may be any suitable conveyance 118 such as a wireline, a slickline, a production tubing, and the like. The downhole tools 114 may be any suitable downhole tools for drilling, completing, and/or producing the wellbore 116, such as drill bits, packers, testing equipment, perforating guns, and the like.

The stripper 104 (or stripper/packer) is preferably configured to allow the conveyance 118 to pass through the stripper 104 and into other subsea equipment, such as the BOP 108, without allowing seawater into the wellbore 116 and/or allowing wellbore fluids out of the wellbore 116. The equipment replacement system 102 may be located in and/or proximate to the stripper 104 and may have one or more seal assemblies 130 (or packer assemblies) and one or more seal assembly replacement systems 132. The seal assembly replacement system 132 may be configured to automatically replace the one more seal assemblies 130 while the stripper 104 is installed on the seabed 107, as will be described in more detail below.

To automate the replacement of the one or more seal assemblies 130, the seal assembly replacement system 132 may be in communication with the controller 126 and/or the subsea controller 128. The seal replacement system 132 may communicate with the controllers 126 and/or 128 via one or more communication links 134. The communication links 134 may be any suitable communication means such as hydraulic lines, pneumatic lines, wiring, fiber optics, telemetry, acoustic device, wireless communication, any combination thereof, and the like. Further, any of the devices and/or systems in the subsea system 106 may communicate with the subsea controller 128 and/or the controller 126 via the communication links 134. Further still, the subsea controller 128 may communicate with the controller 126 via the communication links 134.

It will be appreciated by those skilled in the art that the techniques disclosed herein can be implemented for automated/autonomous applications via software configured with algorithms to perform the desired functions. These aspects can be implemented by programming one or more suitable general-purpose computers having appropriate hardware. The programming may be accomplished through the use of one or more program storage devices readable by the processor(s) and encoding one or more programs of instructions executable by the computer for performing the operations described herein. The program storage device may take the form of, e.g., one or more floppy disks; a CD ROM or other optical disk; a read-only memory chip (ROM); and other forms of the kind well known in the art or subsequently developed. The program of instructions may be "object code," i.e., in binary form that is executable more-or-less directly by the computer; in "source code" that requires compilation or interpretation before execution; or in some intermediate form such as partially compiled code. The precise forms of the program storage device and of the encoding of instructions are immaterial here. Aspects of the invention may also be configured to perform the described functions (via appropriate hardware/software) solely on site and/or remotely controlled via an extended communication (e.g., wireless, internet, satellite, etc.) network.

Figure 2A:
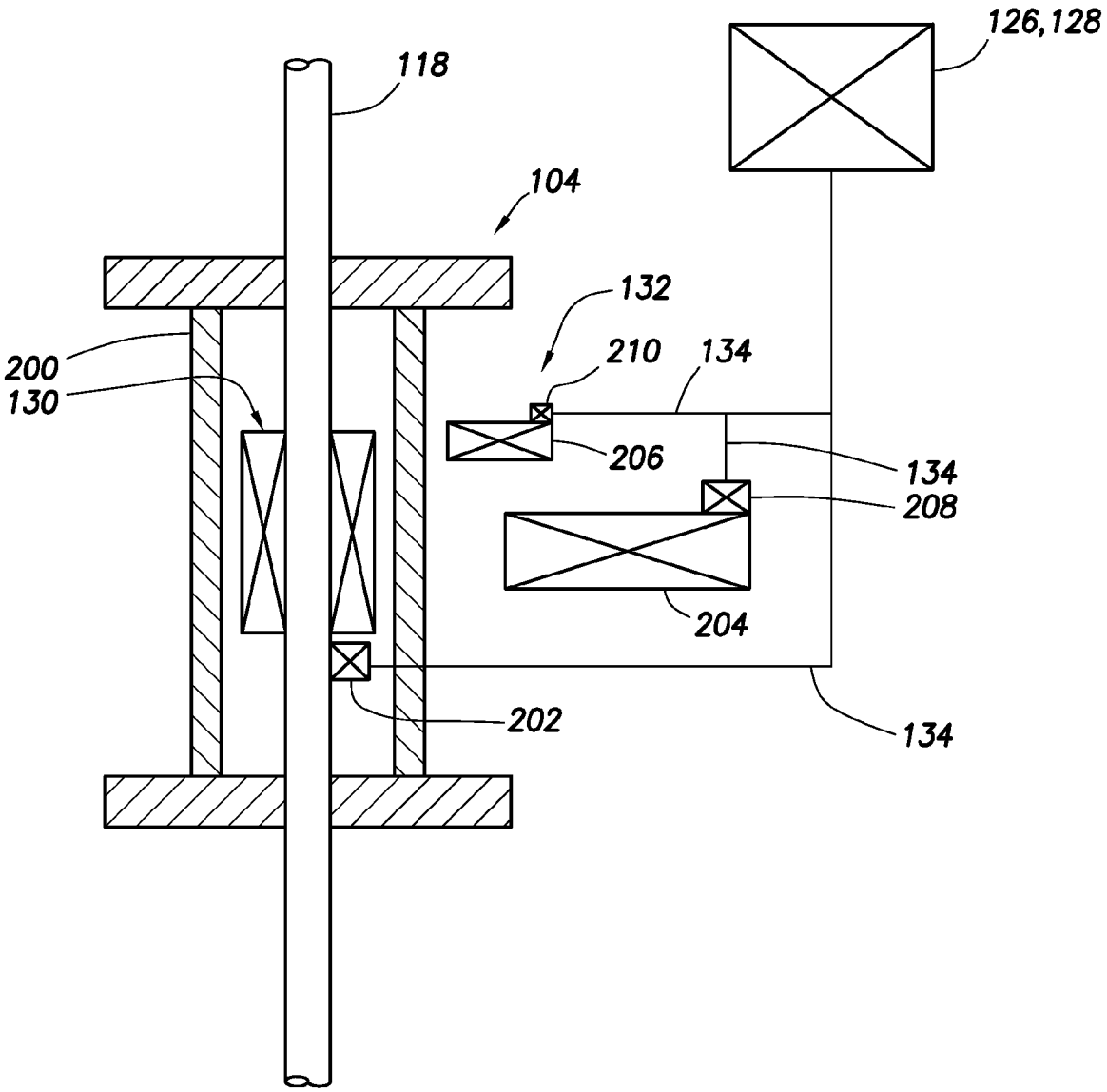
FIGS. 2A and 2B show schematic views of the stripper and the equipment replacement system of FIG. 1.

FIG. 2A shows a schematic cross-sectional view of the stripper 104, and/or a portion of the stripper 104, in an operating position. In the operating position, the one or more seal assemblies 130 are within the stripper 104 and in sealing engagement with the conveyance 118. The one or more seal assemblies 130 allow the conveyance 118 to move into and/or out of the wellbore 116 (as shown in FIG. 1) while sealing the conveyance 118. The one or more seal assemblies 130 may be contained within a door 200 of the stripper 104. The door 200 may allow the one or more seal replacement systems 132 to selectively gain access to the one or more seal assemblies 130 during replacement of the one or more seal assemblies 130 and/or the replacement of one or more of the downhole tools 114 (as shown in FIG. 1). A seal actuator 202 for actuating the one or more seal assemblies 130 into sealing engagement with the conveyance 118 may be located in the stripper 104 and proximate the one or more seal assemblies 130.

The one or more seal replacement systems 132 may have one or more seal replacement arms 204 (or rotary transfer arm) and optionally one or more seal holders 206 (or grippers 206). The one or more seal replacement arms 204 may be configured to move a used seal assembly 130 out of the stripper 104 and replace it with a new seal assembly 130. The one or more replacement arms may have one or more arm actuators 208. The arm actuators 208 may move the one or more replacement arms 204 in order to replace the one or more seal assemblies 130, as will be described in more detail below. The one or more seal holders 206 may be configured to hold the one or more seal assemblies 130 in place temporarily during the seal assembly 130 replacement. The one or more seal holders 206 may have one or more seal holder actuators 210. The seal holder actuators 210 may move the one or more seal holders 206 into an engaged position with the one or more seal assemblies 130 once the door 200 is open.

Figure 2B:
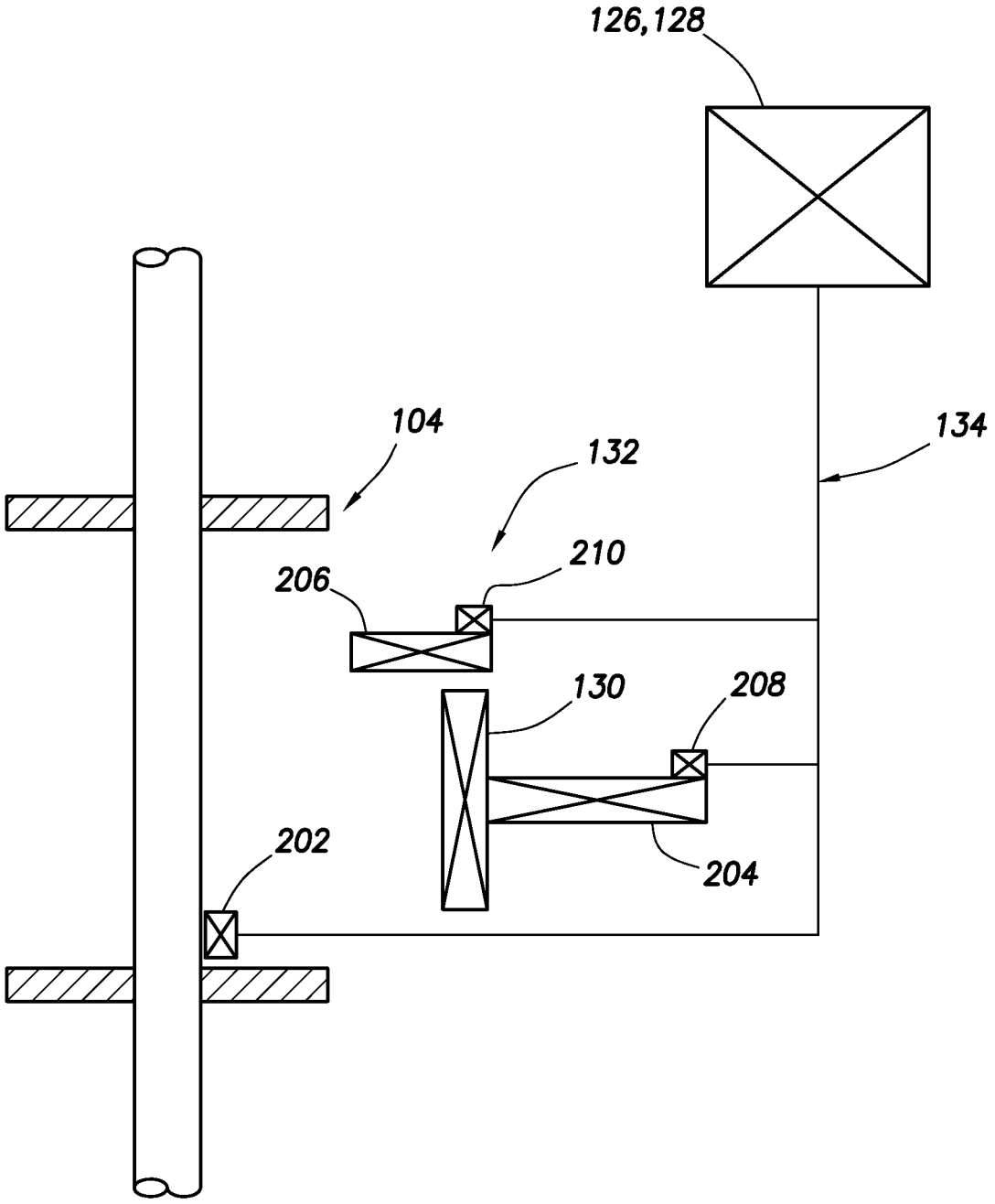

FIG. 2B shows a schematic cross-sectional view of the stripper 104 in the replacement position. In the replacement position, the door 200 (as shown in FIG. 2A) has been opened thereby allowing the seal assembly replacement system 132 to access the seal assembly 130. Thus, FIG. 2A depicts the seal assembly 130 (or packer assembly) half removed from the stripper 104 (or the stripper/packer). The seal assembly 130 (or the packer assembly) may include two halves, split vertically, to allow the seal assembly 130 halves (or packer assembly halves) to be removed from the stripper 104 (or the stripper/packer) when it is worn. The one or more seal replacement arms 204 may engage the one or more used seal assemblies 130. The one or more seal replacement arms 204 may dispose of the used seal assemblies 130. The one or more seal replacement arms 204 may then engage a new seal assembly 130 and locate the new seal assembly back to the operating position. The one or more seal holders 206 may then temporarily engage the one or more seal assemblies 130 in order to secure the seal assemblies 130 in place until the door 200, or another device within the stripper 104, closes and/or secures the one or more seal assemblies to the stripper 104. Although FIGS. 2A and 2B show the stripper as having only one set of seal assemblies 130 it should be appreciated that any suitable number of seal assemblies 130 may be used in series along the length of the stripper 104.

Figure 3C:
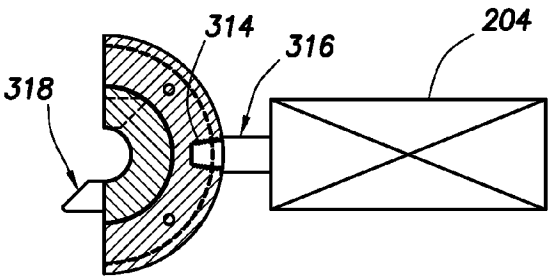
FIG. 3C is a cross-sectional view of the seal assembly of FIG. 3B taken along line 3C-3C.
Figure 3B:
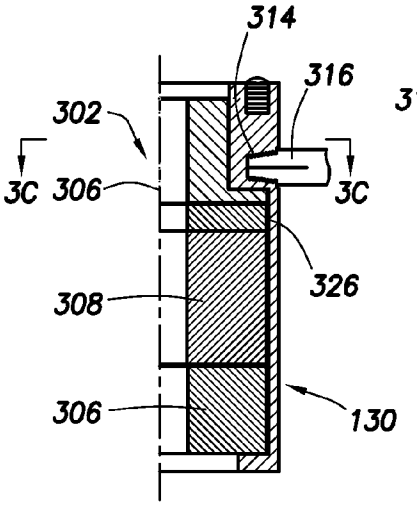
FIG. 3B is a of longitudinal cross-section of the seal assembly of FIG. 3A taken along line 3B-3B.
Figure 3A:
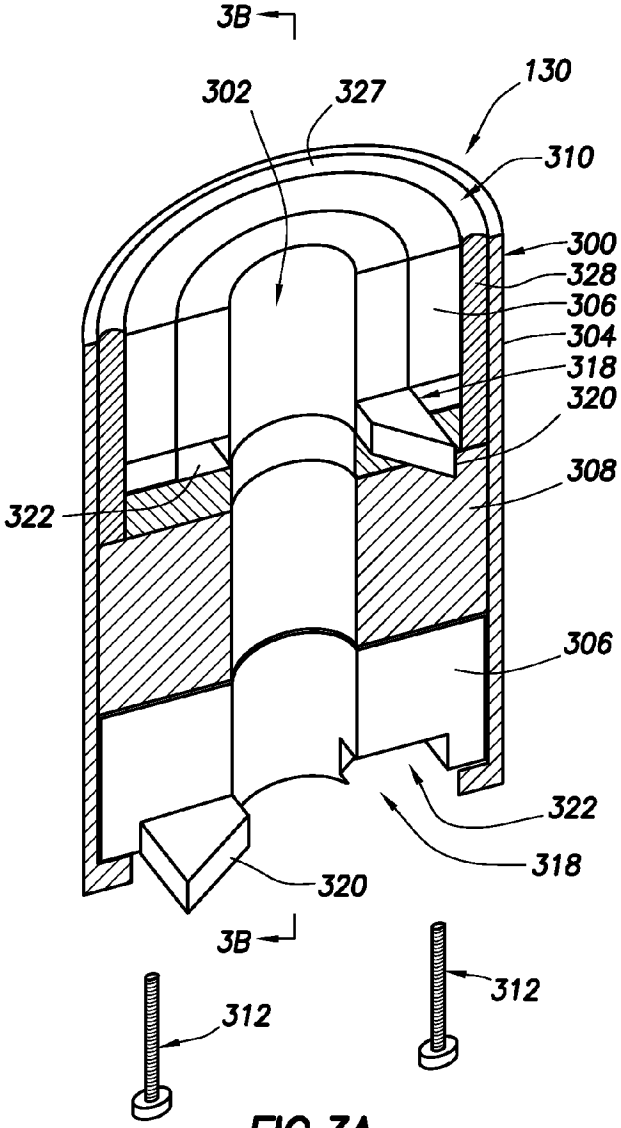
FIG. 3A is a perspective view of a seal assembly.
Figure 3K:
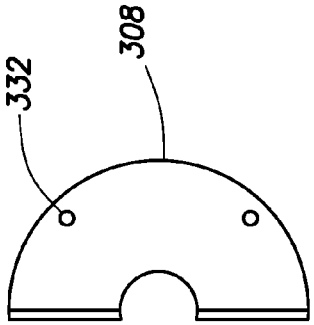
FIG. 3K is a top view of the packer of FIG. 3C.
Figure 3J:
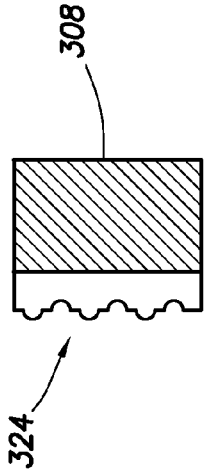
FIG. 3J is a side view of a packer of FIG. 3C.
Figure 3I:
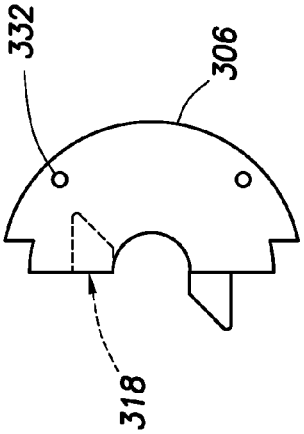
FIG. 3I is a top view of the lower bushing of FIG. 3C.
Figure 3H:
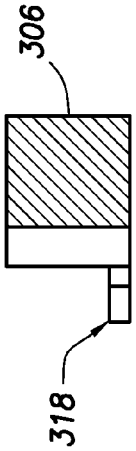
FIG. 3H is a side view of the lower bushing of FIG. 3C.
Figure 3G:
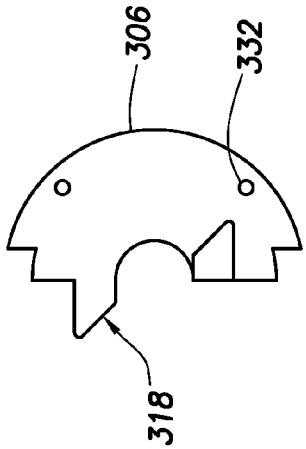
FIG. 3G is a bottom view of a lower bushing of FIG. 3C.
Figure 3F:
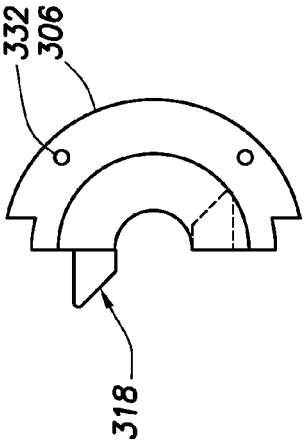
FIG. 3F is a top view of the upper bushing of FIG. 3C.
Figure 3E:
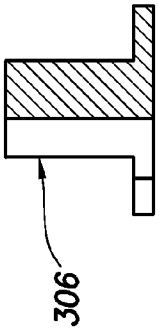
FIG. 3E is a side view of the upper bushing of FIG. 3C.
Figure 3D:
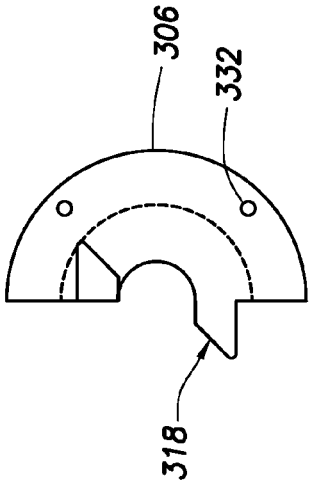
FIG. 3D is a bottom view of an upper bushing of FIG. 3C.
Figure 3P:
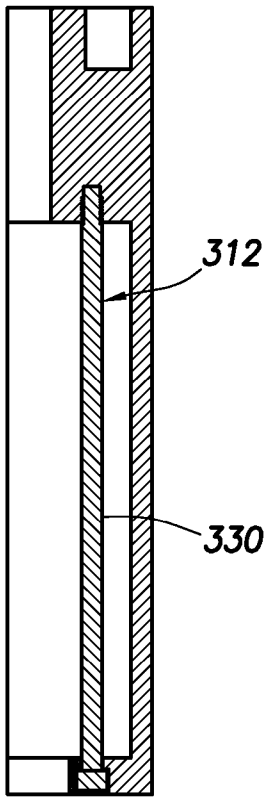
FIG. 3P is a side cross-sectional view of the seal assembly of FIG. 3A showing a packer retaining member.

FIGS. 3A-3P depict various views of a seal assembly and its components usable, for example, as the seal assembly 130. As shown, the one or more seal assemblies 130 has two seal halves 300 (or packer assembly halves) that mate together and form a central bore 302 through which the conveyance 118 (as shown in FIG. 1) may pass through. Although the one or more seal assemblies 130 are shown as having two seal halves 300, it should be appreciated that the seal assemblies 130 may have any number of seal portions.

FIG. 3A shows a perspective view of one half of the seal assembly 130. The seal half 300 (or each seal portion) may have a carrier 304, one or more bushings 306, a packer 308, one or more seals 310, and one or more packer retainer members 312. The seal half 300 may be mated with, or located proximate to, a second seal half 300 to form the seal assembly 130 (or packer assembly) in the operating position.

The carrier 304 may be configured to contain, and/or hold, the one or more bushings 306, the packer 308 and/or the one or more seals 310. Thus, the entire seal assembly 130, including the packer 308 and the bushings 306, may be removed and replaced by replacing the carrier 304. The carrier 304 as shown in FIG. 3A is a canister, or semi-circular container, that has an inner surface formed to receive a back side of the one or more bushings 306 and the packer 308. Although the carrier 304 is shown as being a semi-circular canister, it should be appreciated that the carrier 304 may have any suitable shape capable of containing and/or holding the one or more bushings 306 and the packer 308. The carrier 304 may be constructed of any suitable material such as metal, ceramics, plastic, and the like. In an embodiment, the term "carrier" is used because the polymeric packer and bushing are retained within a metallic shell, so that the packer, bushing, and shell comprise a composite carrier.

The carrier 304 may include a receiver 314 for allowing the one or more seal replacement arms 204 to grab and remove the carrier 304, as shown in FIGS. 3B and 3C. The receiver 314 is shown as a female threaded receiver in the back of the carrier 304. As shown, an engager 316 of the seal replacement arm 204 is engaged with the receiver 314. The engager 316 as shown is a male threaded probe coupled to the seal replacement arm 204. Thus, to engage the carrier 304 with the seal replacement arm 204, the engager 316 may thread into the receiver 314 thereby allowing the seal replacement arm 204 to remove the carrier 304 from the stripper 104, as will be described in more detail below. Though the receiver 314 is shown as a female receiver and the engager 316 is shown as a male threaded probe, it should be appreciated that any suitable arrangement for the receiver 314 to engage the engager 316 may be used.

The one or more bushings 306 as shown in FIGS. 3A and 3B have an upper bushing and a lower bushing. The upper bushing may be located on one side of the packer 308 while the lower bushing may be located on the opposite side of the packer 308. The upper bushing and/or the lower bushing may include a guide portion 318, as shown in FIGS. 3A, 3C, 3D and 3F-3I. The bushings 306 may be configured to secure the packer 308 in the seal assembly 130 and reduce the wear on the packer 308 during the life of the seal assembly 130. The bushings 306 may be constructed of any suitable material such as metal, ceramics, plastics and the like. The bushings 306 as shown may take any shape so long as they secure the packer 308 in the seal assembly 130.

The guide portion 318 may be configured to mate the two seal halves 300 of the seal assembly 130 when the seal assembly replacement system 132 places them together. As shown, the guide portion 318 has an exterior guide 320 and an interior guide 322. The exterior guide 320 and the interior guide 322 may be configured to mate with an opposing interior guide and an opposing exterior guide on the other seal half 300 of the seal assembly 130. Although the guide portion 318 is shown as an exterior guide 320, a male portion configured to engage the interior guide 322, a female portion of an opposing seal half 300, it should be appreciated that the guide portion 318 may have any suitable shape capable of mating the one or more opposing bushings 306 and thereby the seal halves 300 together.

The packer 308 as shown in FIGS. 3A, 3B, 3J and 3K may be a semi-circular packer having the central bore 302 therethrough. The packer 308 half may be configured to mate with an opposing packer 308 half on the opposing seal half 300. The packer 308 may be an elastomeric material configured to expand into sealing engagement with the conveyance 118 (as shown in FIG. 1) upon compression of the packer 308. The packer 308 may have a mating edge 324, as shown in FIG. 3J. The mating edge 324 may be located at each of the packer 308 edges that mate with the opposing packer 308. As shown, the mating edge 324 has a zig-zagged and/or stepped configuration which is configure to mate with an opposing mating edge (not shown).

Figure 3N:
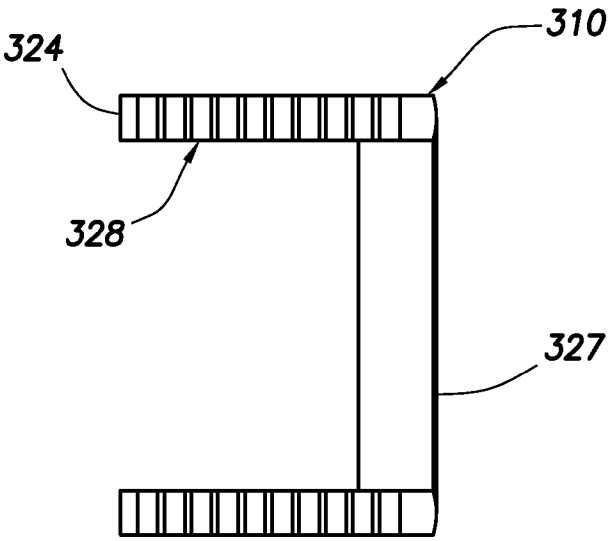
FIG. 3N is an end view of a seal of FIG. 3A.
Figure 3O:
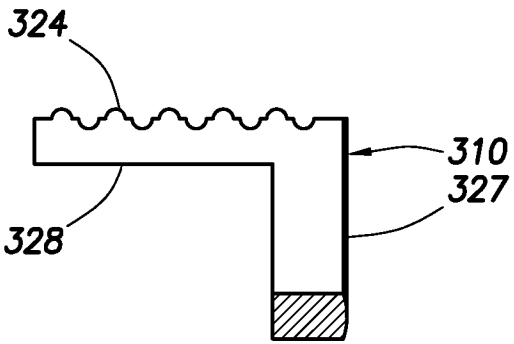
FIG. 3O is a side view of the seal of FIG. 3A.
Figure 3M:
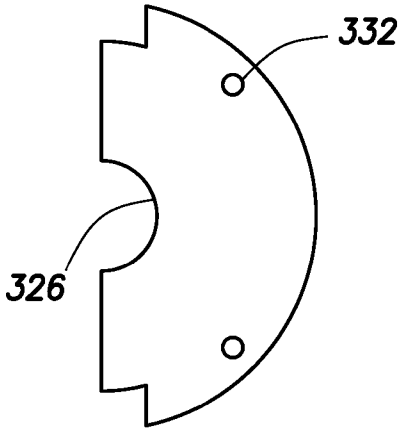
FIG. 3M is a top view of the extrusion ring of FIG. 3C.
Figure 3L:
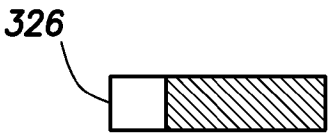
FIG. 3L is a side view of an extrusion ring of FIG. 3C.

The seal assembly 130 may further comprise one or more extrusion rings 326 (or bushing spacers) as shown in FIGS. 3B, 3L and 3M. The extrusion rings may be located between the bushings 306 and the packer 308. The extrusion rings 326 may minimize damage to the packer 308 from the bushing 306 during the life of the seal assembly 130.

The seal 310 is shown in greater detail in FIGS. 3N and 3O. The seal 310 may be configured to substantially prevent fluid flow between the carrier 304 and the bushings 306 as well as to form a seal between the seal halves 300, or portions, of the seal assembly 130. As shown in FIG. 3A, the seal 310 has a semi-circular top 327 configured to secure between the top of the carrier 304 and the top of the bushing 306. The seal 310 may further have a side portion 328 that is configured to form a seal between the carrier 304 and the bushing 306 while mating with an opposing seal on the opposite half of the seal assembly 130. The side portion 328 may further have a mating edge 324 (as shown in FIGS. 3N and 3O) similar to the mating edge 324 of the packer 308 (as shown in FIG. 3J).

The packer retainer member 312 may be any suitable device for securing the packer 308 and the one or more bushings 306 to the carrier 304. As shown in FIGS. 3A and 3P, the packer retaining member 312 is one or more retaining bolts 330 configured to secure through an aperture 332 (as shown in FIGS. 3A, 3D, 3F, 3G, 3I, 3K, and 3M) in the bushings 306, the packer 308 and the extruder ring 326. Although the packer retainer member 312 is shown as one or more retaining bolts 330 configured to secure through the aperture 332, it should be appreciated that the packer retainer member 312 may be any suitable device for securing the one or more bushings 306, the packer 308 and/or the extruder ring 326 to the carrier 304.

The packer retaining member 312 may be configured to replace the carrier 304. In this configuration, the packer retaining member 312 may hold the bushings 306, the packer 308 and/or the extruder rings 326 together without the need for the carrier 304. Also, the receiver 314 may be located in, or be integral with, the packer 308, the one or more bushings 306 and/or the extruder ring 326.

Figure 4A:
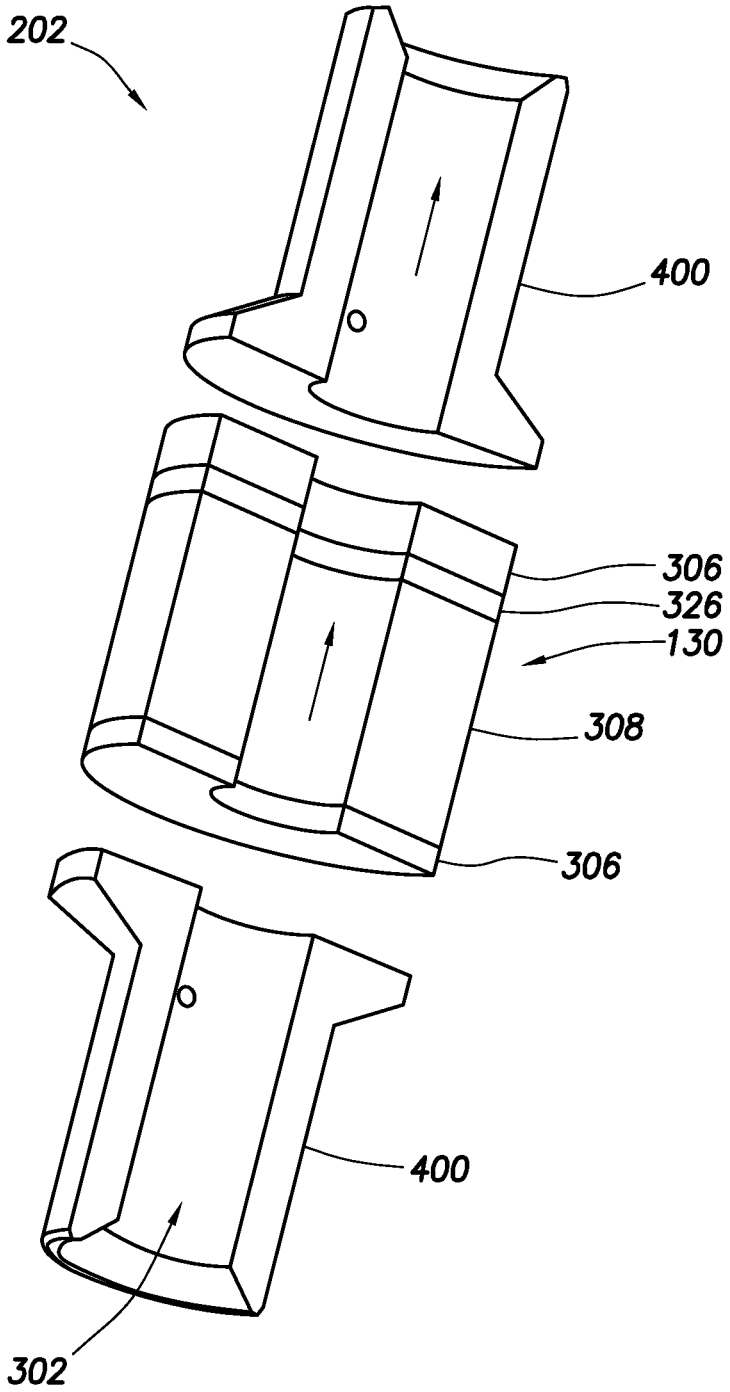
FIG. 4A shows a perspective view of the seal assembly and a portion of the packer actuator.
Figure 4B:
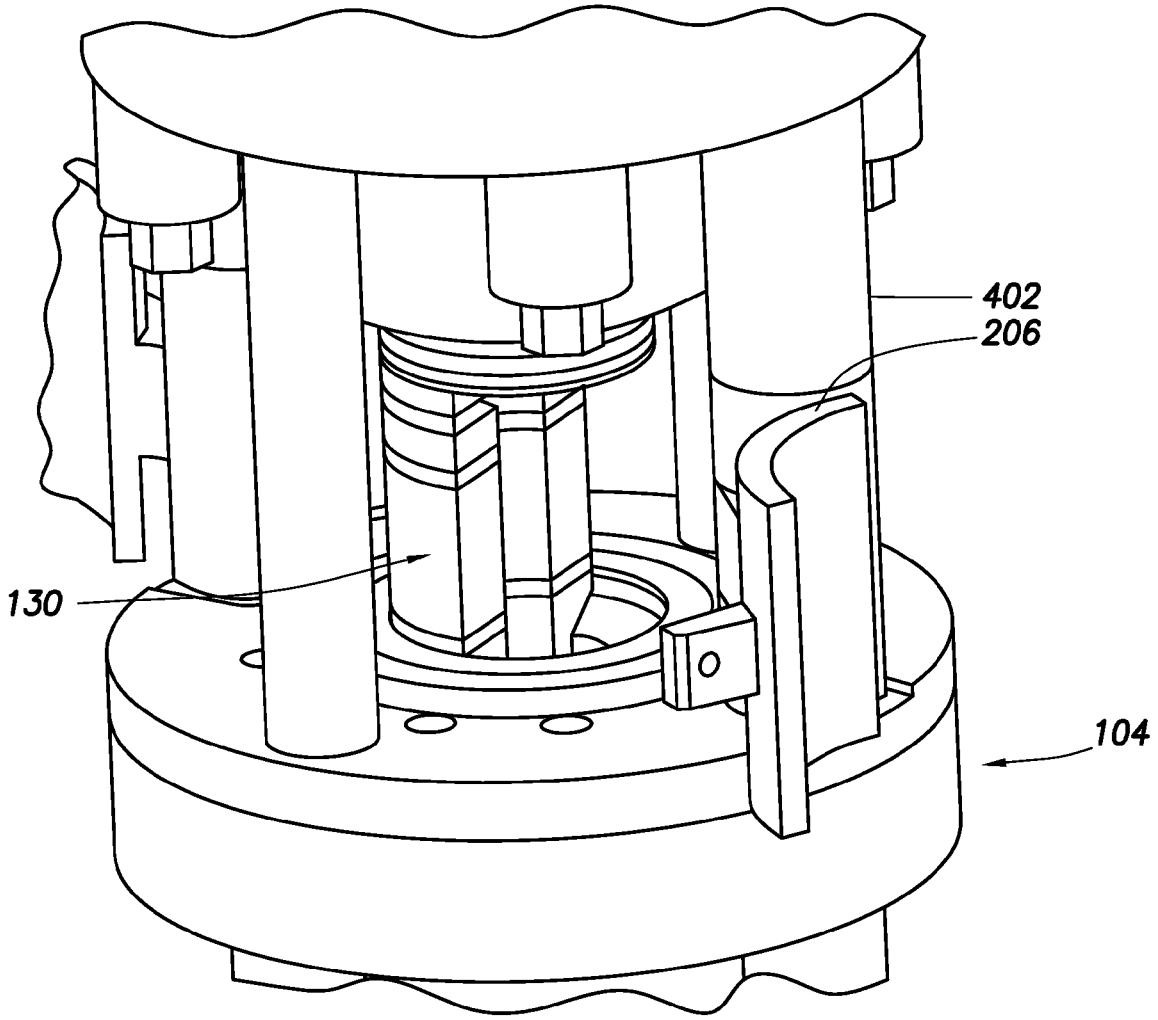
FIG. 4B shows a perspective view of a portion of the stripper of in FIG. 2B.
Figure 5:
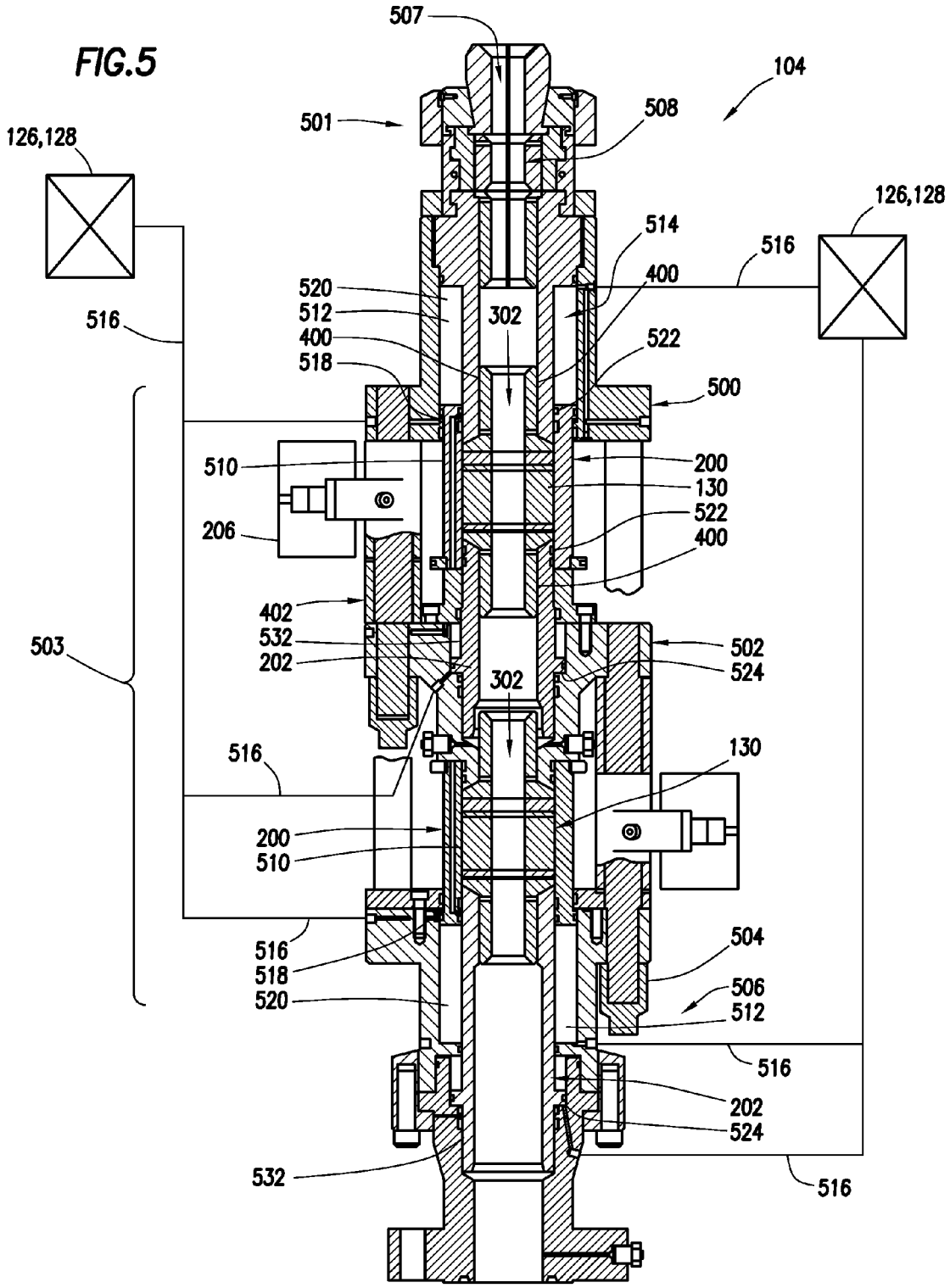
FIG. 5 shows a cross-sectional view of the stripper of in FIGS. 2A and 2B.

FIGS. 4A, 4B and 5 depict a stripper for replacing, for example, a seal assembly. FIG. 5 shows a stripper usable, for example, as the stripper 104 usable with the packer actuator 202 herein. FIG. 4B shows a portion of the stripper 104 of FIG. 5 with half of the seal assembly 130 therein. FIG. 4A is a detailed view of two bushing packers of the stripper 104 of FIGS. 4B and 5 with the seal assembly 130 therebetween.

FIG. 4A shows a perspective view of seal assembly 130 between two bushing packers 400. The bushing packers 400 may form a portion of the packer actuator 202. The bushing packers 400 may engage one or more ends of the seal assembly 130 in order to actuate the seal assembly 130 once installed, as will be discussed in more detail below. The bushing packers 400 may have the central bore 302 configured to allow the conveyance 118 (as shown in FIG. 1) to pass through the bushing packers 400. The bushing packers 400 may include a seal assembly retaining member (not shown) that secures the seal assembly within the stripper 104 before the door 200 (as shown in FIG. 2A) is closed. The seal assembly retaining member may alleviate the need for the one or more seal holders 206 as shown in FIGS. 2A and 2B.

FIG. 4B shows a perspective view of one half of the seal assembly 130 located in the stripper 104. FIG. 4B shows the door 200 (as shown in FIG. 2) in the open position. The one or more seal holders 206 are shown in a disengaged position from the seal assembly 130 thereby allowing the door 200 to close. As shown, the seal holders 206 are two seal holders 206 secured to one or more stripper retaining bolts 402. The stripper retaining bolts 402 (or large retaining bolts 402) may be configured to hold a portion of the stripper 104 together.

FIG. 5 shows a cross-sectional view of the stripper 104. As shown, the stripper 104 has two seal assemblies 130 in series. Having two or more seal assemblies 130 allows one seal assembly 130 to be replaced while another seal assembly 130 maintains the stripper's 104 seal with the conveyance 118 (as shown in FIG. 1). The stripper 104 has a stripper central bore 507 that may be longitudinally aligned with the central bore 302 of the seal assemblies 130. The central bore 507 allows the conveyance 118 to be run through the stripper 104 while sealing the pressure upstream and/or downstream with one or more of the seal assemblies 130.

The stripper 104 may have an injection portion 501, a seal assembly portion 503, and a tool connection portion 506. The injection portion 501 may serve as the entry and/or exit point for the conveyance 118 on the upstream side of the stripper 104. The injection portion 501 may be configured to connect to a tool such as the conveyance delivery system 112 (as shown in FIG. 1). The conveyance delivery system 112 may inject the conveyance 118, such as a coiled tubing, into the stripper 104. The injection portion 501 may include a conveyance bushing 508 configured to guide the conveyance 118 as it enters the stripper 104.

The tool connection portion 506 may be configured to secure the stripper 104 to another tool, and/or pipe, downstream of the stripper 104, for example the BOP 108 (as shown in FIG. 1). The tool connection portion 506 as shown is a flange configured to bolt onto the tool, although it should be appreciated that any connection may be used.

The seal assembly portion 503 of the stripper 104, as shown has two replaceable seal assemblies 130 in series. Because the parts used for the replacement of each of the seal assemblies 130 may be similar, only one of the seal assemblies 130 will be described in detail herein. The seal assembly 130 may be removed and replaced from the stripper 104 while the stripper 104 is on the sea floor. The seal assembly portion 503 may have the door 200, the packer actuator 202, the seal assembly 130, the packer bushings 400, the one or more seal holders 206, an upper body 500, an intermediate body 502 and a lower body 504.

The lower body 504, the intermediate body 502, and the upper body 500 may be held together with the stripper retaining bolts 402, or large retaining bolts. The stripper retaining bolts 402 may be a support frame for the seal assembly portion 503. Further the stripper retaining bolts 402, as shown, support the one or more seal holders 206. Although the stripper 104 is described as being supported and/or held together by the stripper retaining bolts 402, it should be appreciated that any device for supporting the seal assembly portion 503 of the stripper together may be used.

The stripper 104, or stripper/packer, may be provided with the door 200, or a hydraulically operated door assembly. The door 200 is configured to permit the remote operation of the door 200, thereby permitting access to the interior of the stripper 104 (or stripper/packer), which retains the seal assembly 130 (or the packer assembly). The door 200 may engage a portion of the seal assembly 130 in the closed position in order to secure the seal assembly 130. The door 200 as shown in FIG. 5 is a cylindrical sleeve 510 configured to enclose and seal the seal assembly 130 within the stripper 104 in the closed position. In the open position (as shown in FIG. 4B) the cylindrical sleeve 510 moves into a cylindrical cavity 512 (as shown in FIG. 5). The cylindrical cavity 512 may be sized to substantially house the door 200 in a position that allows access to the seal assembly 130.

The door 200 may include a door actuator 514 configured to move the door 200. As shown the door actuator 514 is a hydraulic actuator. The hydraulic actuator may have one or more hydraulic lines 516 configured to supply hydraulic fluid to the door actuator 514 in order to move the door 200. As shown, the door 200 is opened by supplying hydraulic fluid to an open chamber 518. As the pressure in the open chamber 518 increases, the pressure in the chamber will act on the cylindrical sleeve 510 in order to move the cylindrical sleeve 510 into the cylindrical cavity 512. The door 200 is closed by supplying hydraulic fluid to a close chamber 520. As shown, the close chamber 520 is the same as the cylindrical cavity 512, although it should be appreciated that any close chamber 520 may be used so long as upon supplying pressure to the close chamber 520, the door 200 is forced toward the closed position.

The hydraulic lines 516 may be supplied by one or more hydraulic systems. The hydraulic systems may have any suitable device and/or devices for controlling the door actuator 514 such as at least one pump, pressure gauges, relief valves, and the like. The hydraulic system and/or the door actuator 514 may be in communication with the controllers 126 and/or 128 in order to control the movement of the door 200 automatically and/or remotely.

As an alternative to closing the door 200 hydraulically, there may be one or more door biasing members, not shown, for biasing the door 200 toward the closed position. The one or more door biasing members may be located within the cylindrical cavity 512 (as shown in FIG. 5) and constantly bias the door 200 toward the closed position. Thus, the door 200 may be opened using the hydraulic system. In order to close the door 200 pressure may be reduced from the hydraulic system thereby allowing the one or more door biasing members to close the door 200. The door 200 may have one or more seals 522 configured to seal the interior of the stripper 104, the close chamber 518 and/or the open chamber 520. The seals 522 may be standard o-ring type seals or any suitable seal.

Although the door actuator 514 is shown as being operated by the hydraulic system it should be appreciated that any suitable system and/or device may actuate the door 200 such as one or more servos, a pneumatic system, a mechanical actuator and the like. Further, although the door 200 is shown as a cylindrical sleeve 510 it should be appreciated that the door 200 may be any suitable door 200 for sealing the stripper 104 in the closed position and allowing access to the seal assembly 130 in the open position, such as a hinged door and the like.

The packer actuator 202 may be configured to compress the seal assemblies 130 (and/or the installed carrier 304) and thereby compress the packer 308 into a sealing engagement with the conveyance 118 (as shown in FIG. 1). The packer actuator 202 may compress the seal assembly between the packer bushings 400. The packer actuator 202 may be hydraulically actuated.

As shown, the packer actuator piston 532 may be moved in order to engage one of the packer bushings 400. The engagement of the packer actuator piston 532 to the packer bushing 400 may compress the seal assembly 130 between the two packer bushings 400. The packer actuator 202 may include a packer actuation chamber 524 (as shown in the un-actuated position) that is supplied hydraulic pressure by the hydraulic system via the one or more hydraulic lines 516. As described above, the hydraulic system may be a controller and/or in communication with the controllers 126 and/or 128 in order to automatically and/or remotely control the packer actuator 202. Although the packer actuator 202 is described as being hydraulically operated it should be appreciated that any method of controlling the packer actuator 202 may be used such as pneumatically, electrically, mechanically and the like.

The one or more seal holders 206 (or grippers) as shown in FIG. 5 may couple to the one or more stripper retaining bolts 402. The one or more seal holders may rotate into and out of engagement with the seal assembly 130 when the door 200 is open and closed respectively, as will be described in more detail below.

Figure 6A:
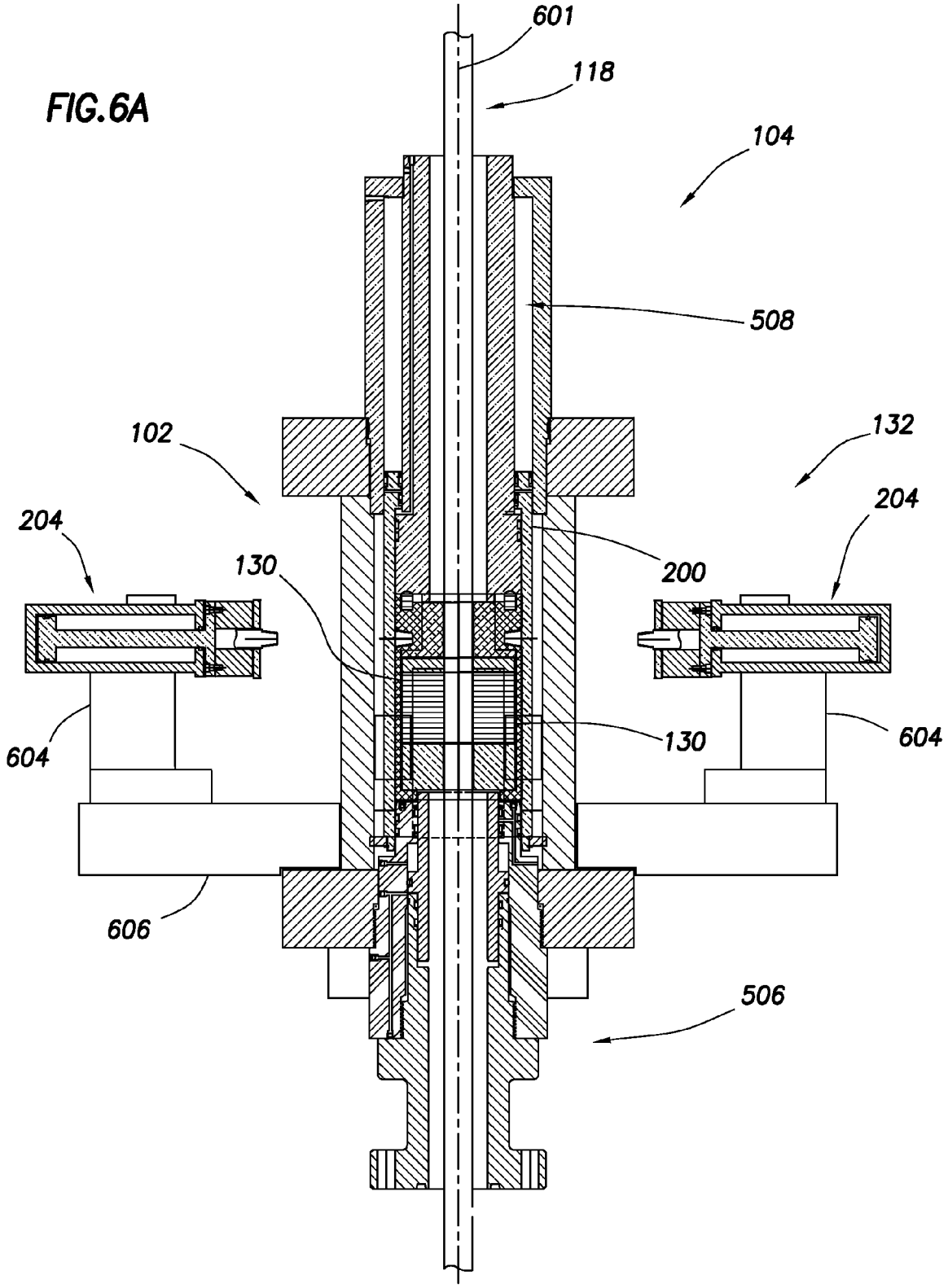
FIG. 6A shows a side view of the stripper of FIGS. 2A and 2B.
Figure 6B:
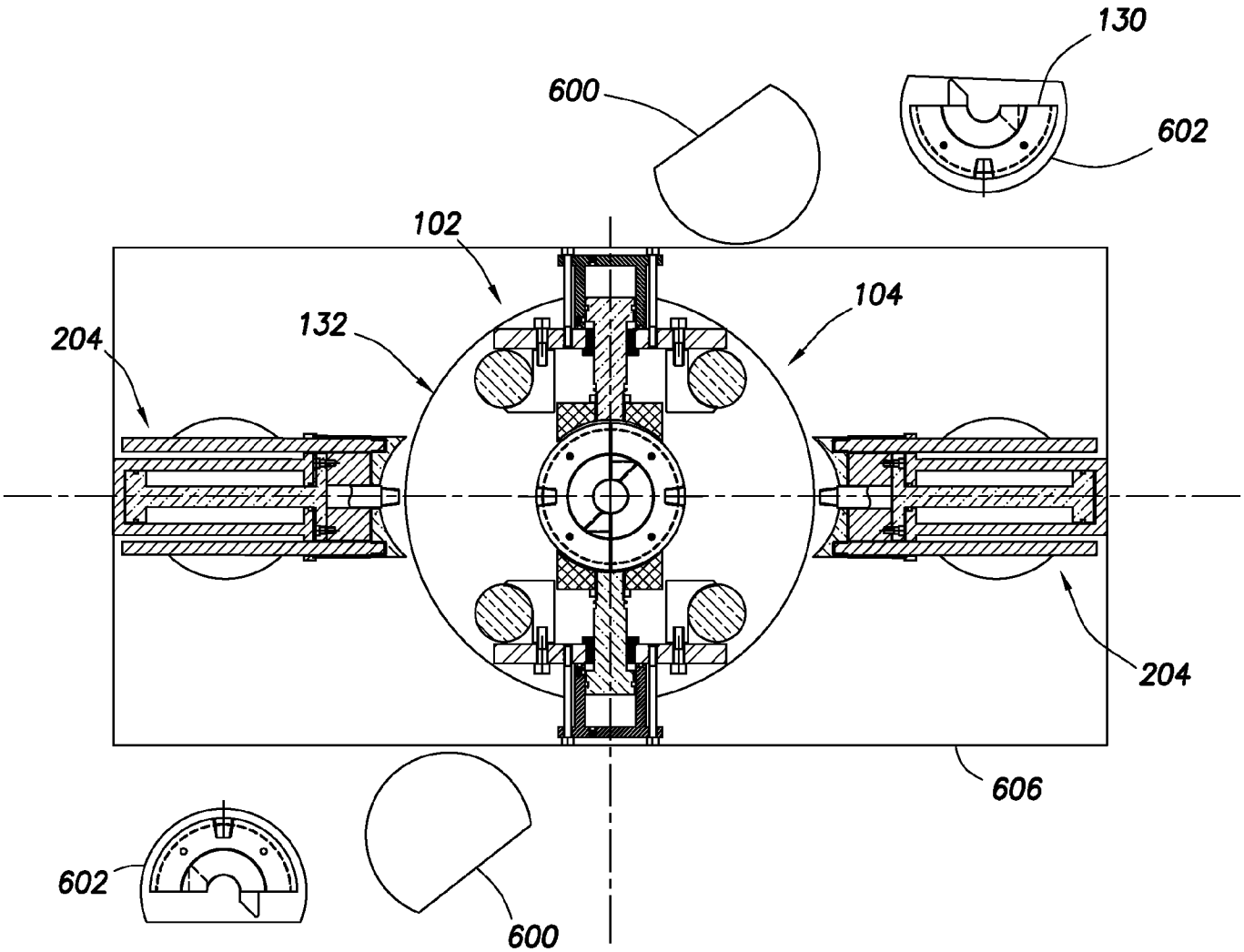
FIG. 6B shows a top view of the stripper of FIGS. 2A and 2B.
Figure 6C:
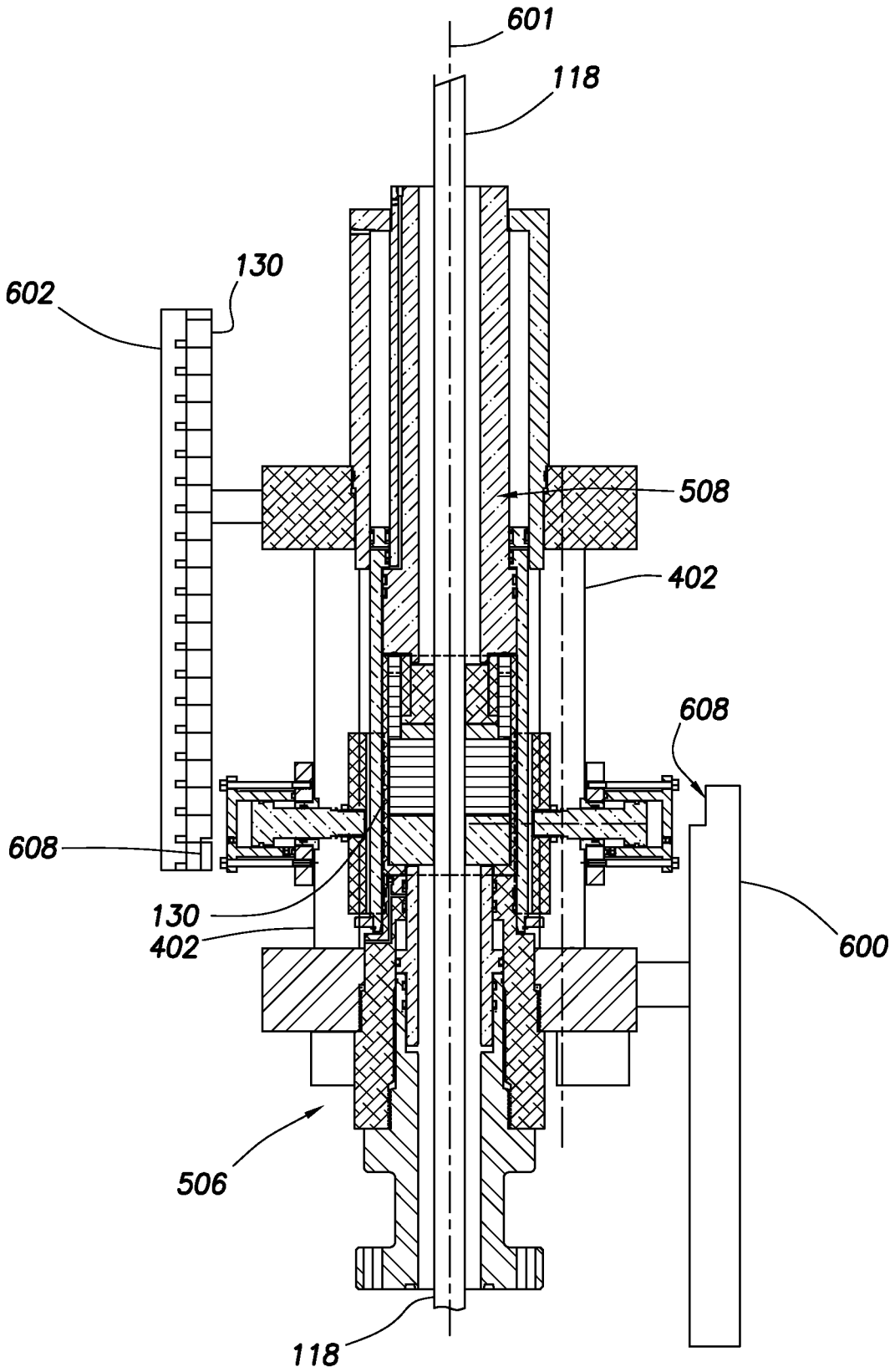
FIG. 6C shows an end view of the stripper of FIGS. 2A and 2B.

FIGS. 6A-6C show various views of a stripper usable, for example as the stripper 104 for replacing subsea equipment, such as the seal assembly 130. These figures depict the storage and retrieval of seal assemblies 130 to and from the stripper 104. FIG. 6A shows a side view of the stripper 104 with the seal replacement arms 204. The stripper 104 (or stripper/packer) is shown with a section of the conveyance 118, in this case a coiled tubing, positioned within the stripper/packer, and coaxial with an axis 601 of the stripper/packer. The stripper 104 has the seal assembly 130 installed and the door 200 in the closed position. In this operating position, the conveyance 118 may move longitudinally along the axis 601 without substantially losing pressure upstream and/or downstream of the stripper 104. In this operating position, the one or more seal replacement arms 204 of the seal replacement system 132 are in a retracted position and not in contact with the seal assembly 130. The one or more seal replacement arms 204 may be coupled to the stripper 104 via a replacement arm support 604. The replacement arm support 604 may couple to the stripper 104 by any suitable means. As shown, a plate connector 606 couples the replacement arm support 604 to the stripper 104.

FIG. 6B shows a top view of the stripper 104 in the operating position. As shown the one or more seal replacement systems 132 may have a used packer bin 600 and a new packer bin 602. The used packer bin 600 may provide a receptacle that the used and/or worn seal assembly 130 may be placed in after the seal replacement arms 204 remove them from the stripper 104. The new packer bin 602 may supply new seal assemblies 130 to the one or more seal replacement arms 204 to be installed in the stripper 104. Thus, before the operations commence, the new packer bin 602 may be full of new seal assemblies 130 while the used packer bin 600 is empty, as shown in FIGS. 6B and 6C.

The seal replacement system 132 may replace the seal assemblies 130 on the stripper 104 until all of the new seal assemblies 130 from the new packer bin 602 have been installed. As shown, the used packer bin 600 and the new packer bin 602 are cylindrical tubes having a partially open portion 608 for allowing the removal and/or disposal of the seal assemblies 130 as shown in FIG. 6C. As shown, the seal assembly 130 halves may be fed to the open portion 608 using gravity to pull the seal assemblies 130 toward the open portion 608 in the new packer bin 602.

The packer bins 600 and 602 may couple to the stripper 104 using any suitable method. The used bin, or used packer bin 600, may be an open top tube of sufficient length to hold all of the anticipated used carriers, or used seal assembly 130 halves. The new bin, or new packer bin 602, may have an opening on the lower side in order that a carrier, or seal assembly 130 half may be accessed thereby allowing the seal assembly 130 to be removed. When one seal assembly 130 half is removed, the next one may drop down, ready for the next change out. The packer bins 600 and 602 preferably retain a plurality of the seal assembly 130 halves and/or carriers.

Figure 7A:
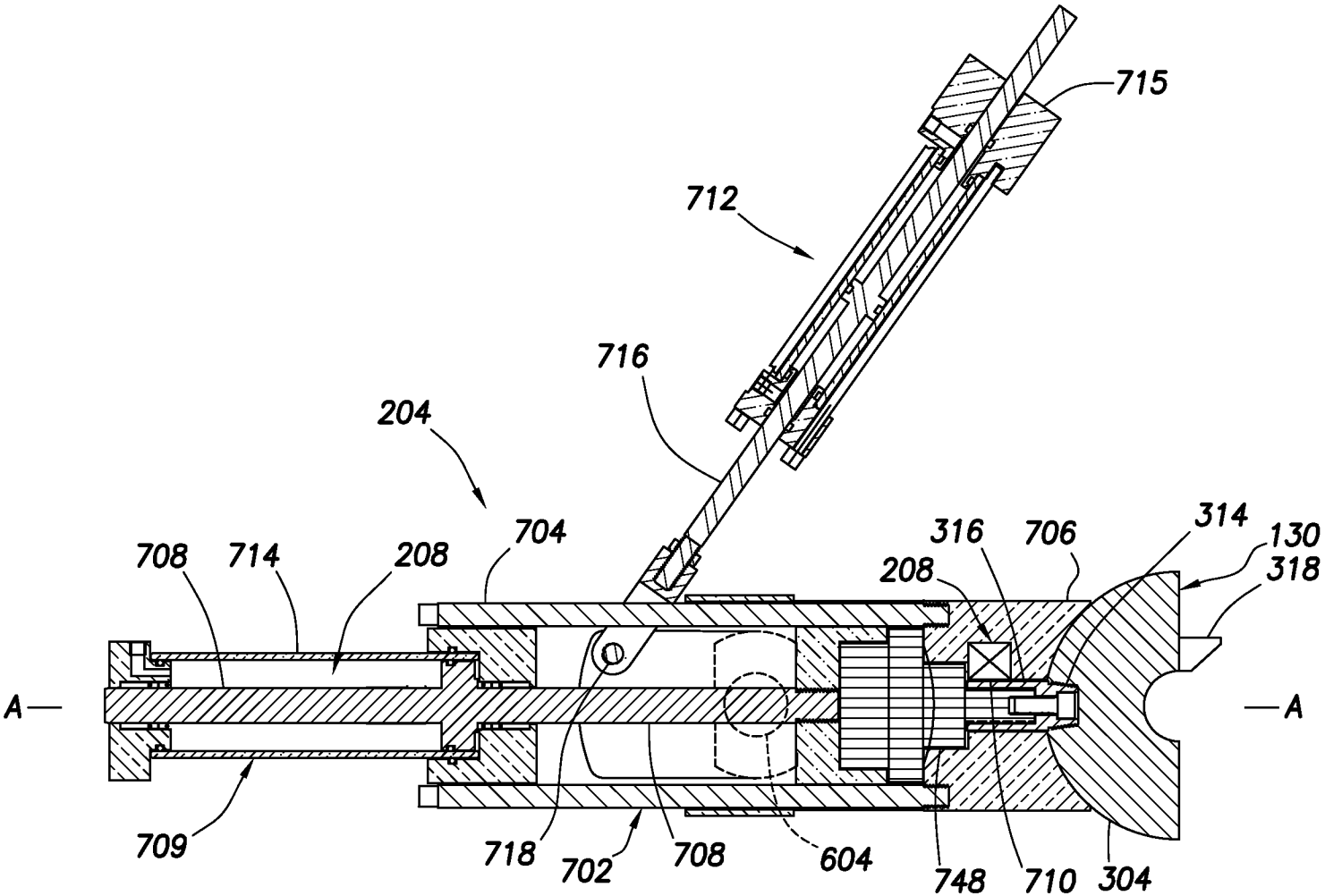
FIG. 7A shows a top cross-sectional view of a seal replacement arm.
Figure 7B:
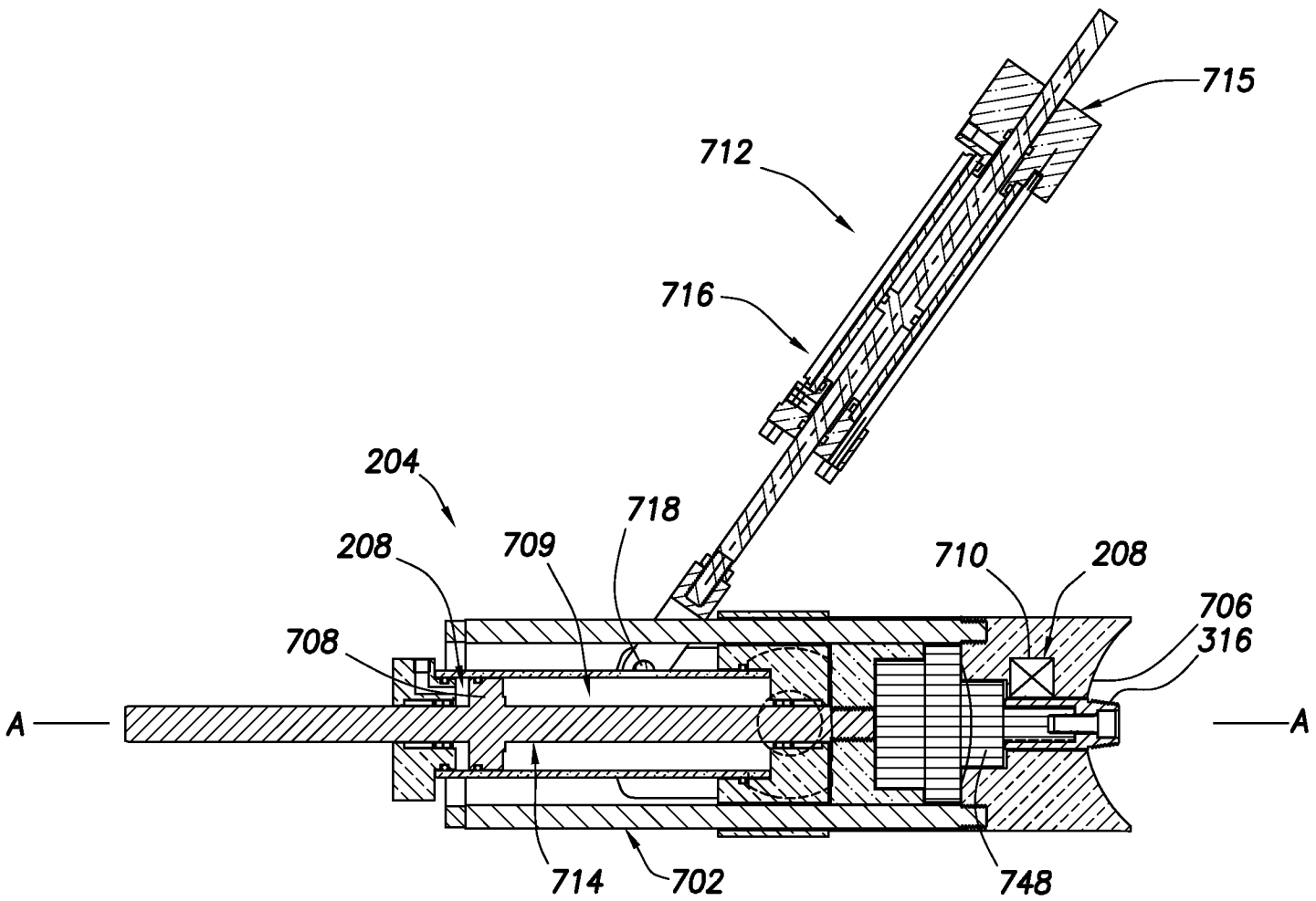
FIG. 7B shows a top cross-sectional view of the seal replacement arm.
Figure 7C:
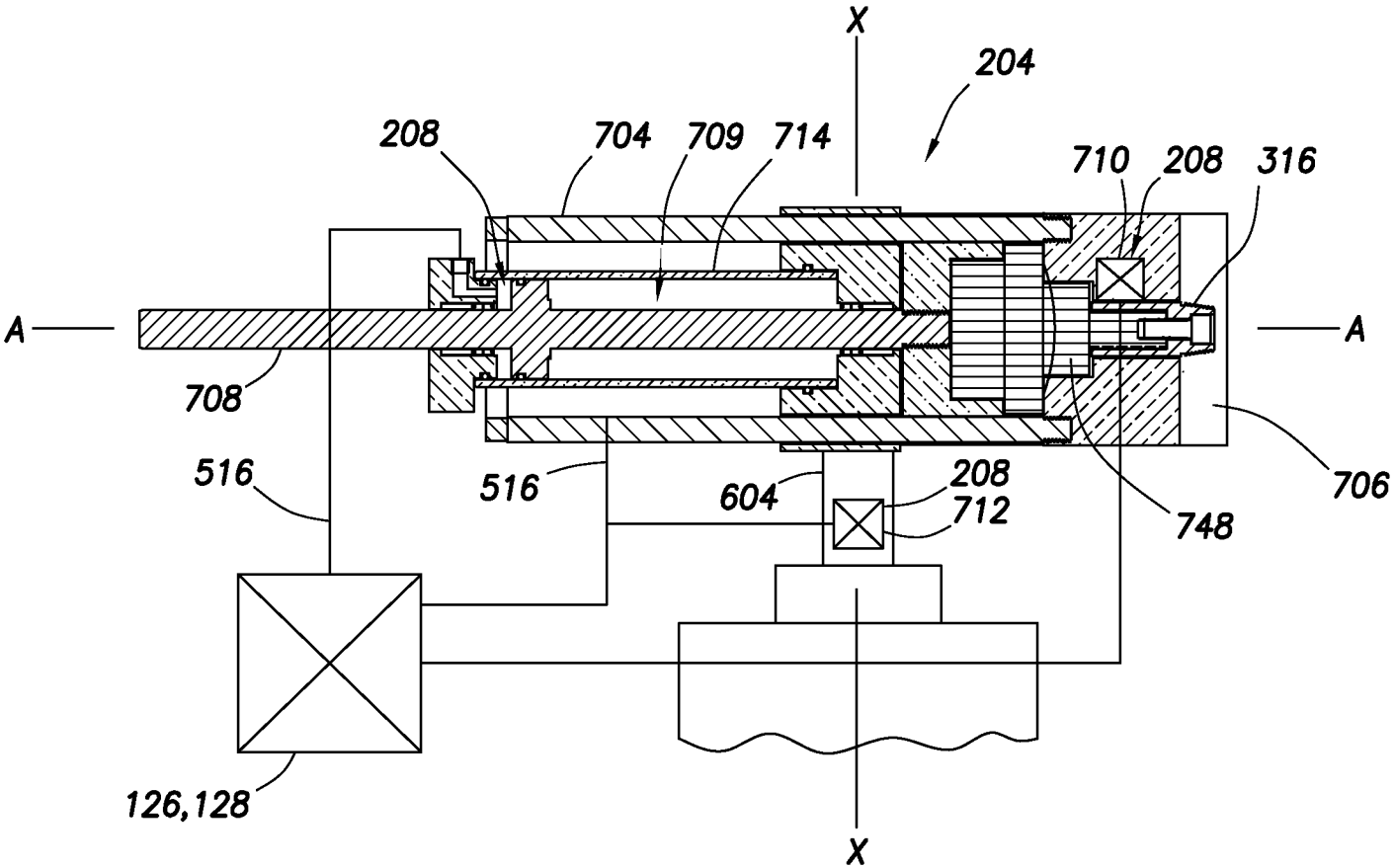
FIG. 7C shows a side cross-sectional view of the seal replacement arm.

The one or more seal replacement arms 204 may be any device and/or system capable of removing and replacing the seal assemblies 130 from the stripper 104. FIGS. 7A-7D depict an example of a configuration of arms usable as the replacement arms 204 for engaging the seal assembly 130. As shown in FIGS. 7A-7C each of the one or more seal replacement arms 204 has the one or more arm actuators 208, the engager 316 and an arm frame 702. The arm frame 702 may be configured to support at least a portion of the one or more arm actuators 208. As shown, the arm frame 702 may include one or more support members 704 and a seal assembly guide portion 706. The support members may support and/or guide a portion of a piston 708 of the one or more actuators 208 as the piston 708 moves axially. The support members 704 may be any suitable members for supporting and/or guiding the piston 708. The seal guide portion 706 as shown is a semi-circular member configured to align and engage the edge of the seal assembly 130 half as shown in FIG. 7A. The engager 316 may protrude through the seal guide portion 706 in order to mate with the receiver 314 of the seal assembly 130.

The one or more arm actuators 208 may include an arm piston actuator 709, an engager actuator 710 and an arm rotation actuator 712. The arm piston actuator 709 may be configured to move the piston 708 and thereby the engager 316 axially toward and away from the seal assembly 130 along axis A-A. The arm piston actuator 709 may include a cylinder 714 for housing a portion of the piston 708. The piston 708 and cylinder 714 may operate like a standard piston and cylinder in order to axially extend and retract the piston 708 and thereby the engager 316. The arm piston actuator 709 may be supplied with hydraulic fluid from the hydraulic system, as described above, via the hydraulic lines 516.

The engager actuator 710, shown schematically, may be any suitable device for rotating the engager 316 in order to engage and disengage the receiver 314. In one example, a hydraulic motor 748 (as shown in FIG. 7A-C) may rotate the engager 316. The hydraulic motor 748 may rotate the engager 316 in either direction in order to engage and disengage the receiver 314. The engager actuator 710 and/or the motor may be in communication with the controller 126 and/or 128 and/or the hydraulic system via any combination of communication links 134 (as shown in FIG. 1) and/or hydraulic lines 516.

Figure 7D:
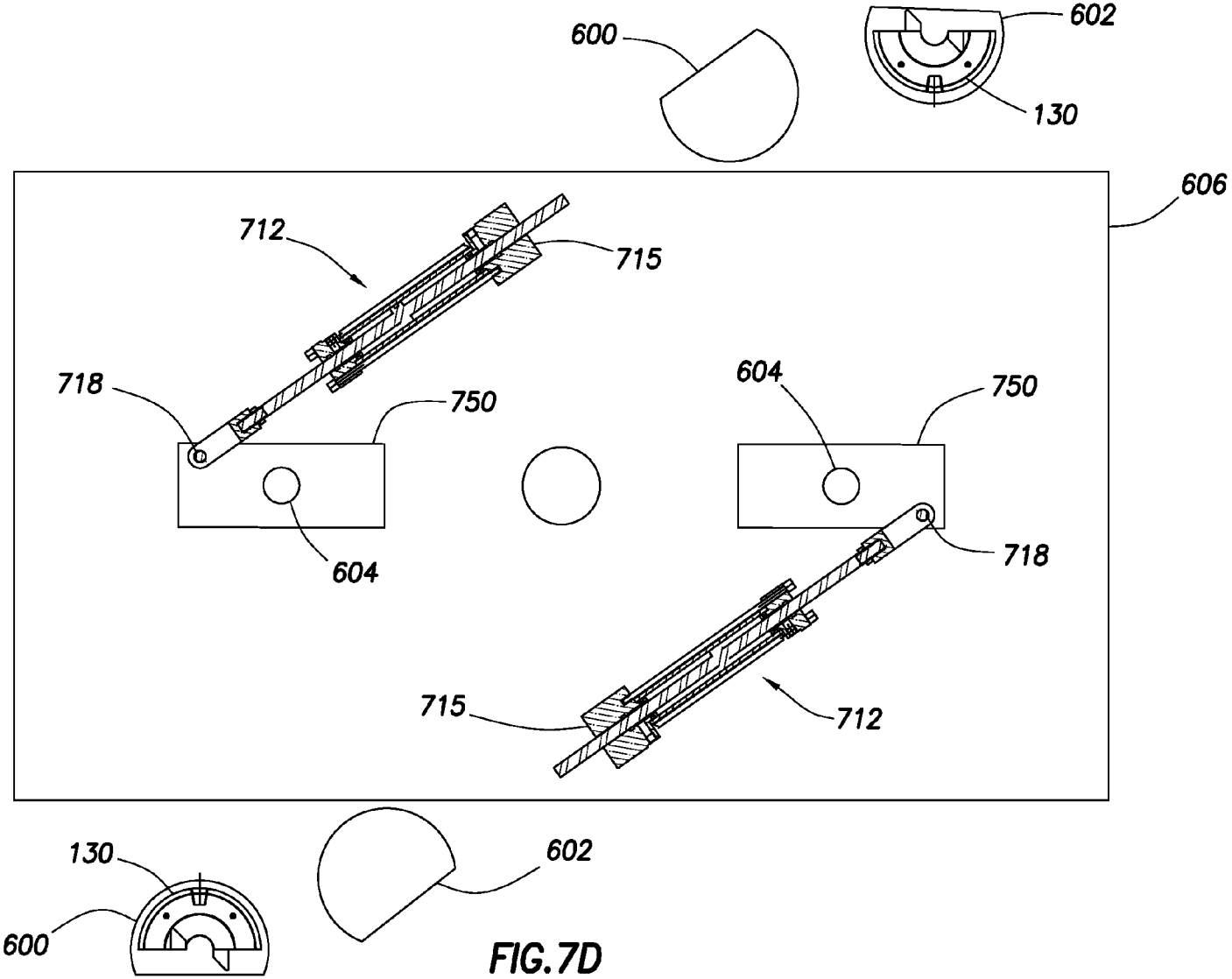
FIG. 7D is a top view of a seal replacement arm actuator.

The arm rotation actuator 712 may be located on or proximate to the replacement arm support 604. The replacement arm support 604 may couple to the replacement arm 204 with a connection that allows the replacement arm 204 to rotate about an X-X axis, as shown in FIG. 7C such as with a pin type connection. The arm rotation actuator 712 may be a piston and cylinder actuator 716, as shown in FIG. 7A. The piston and cylinder actuator 716 may be a standard piston and cylinder having a fixed end 715 coupled to a portion of the stripper 104, and/or the seal replacement system 132, and a motive end 718. The motive end 718 may couple to a portion of the replacement arm 204 and/or the replacement arm support 604. As the motive end 718 is moved toward and away from its fixed end 715 it rotates the replacement arm 204 about the axis X-X of the replacement arm support 604. As shown in FIG. 7D the arm rotation actuator 712 is attached to the plate connector 606. The fixed end 715 may connect to the plate connector and the motive end 718 may connect to an actuator plate 750 coupled to the replacement arm support 604.

Although, the one or more arm actuators 208 are described as being hydraulically operated it should be appreciated that the actuators 208 may be operated using any manner of actuation such as pneumatic, electrical, mechanical, a combination thereof, and the like.

Figure 8:
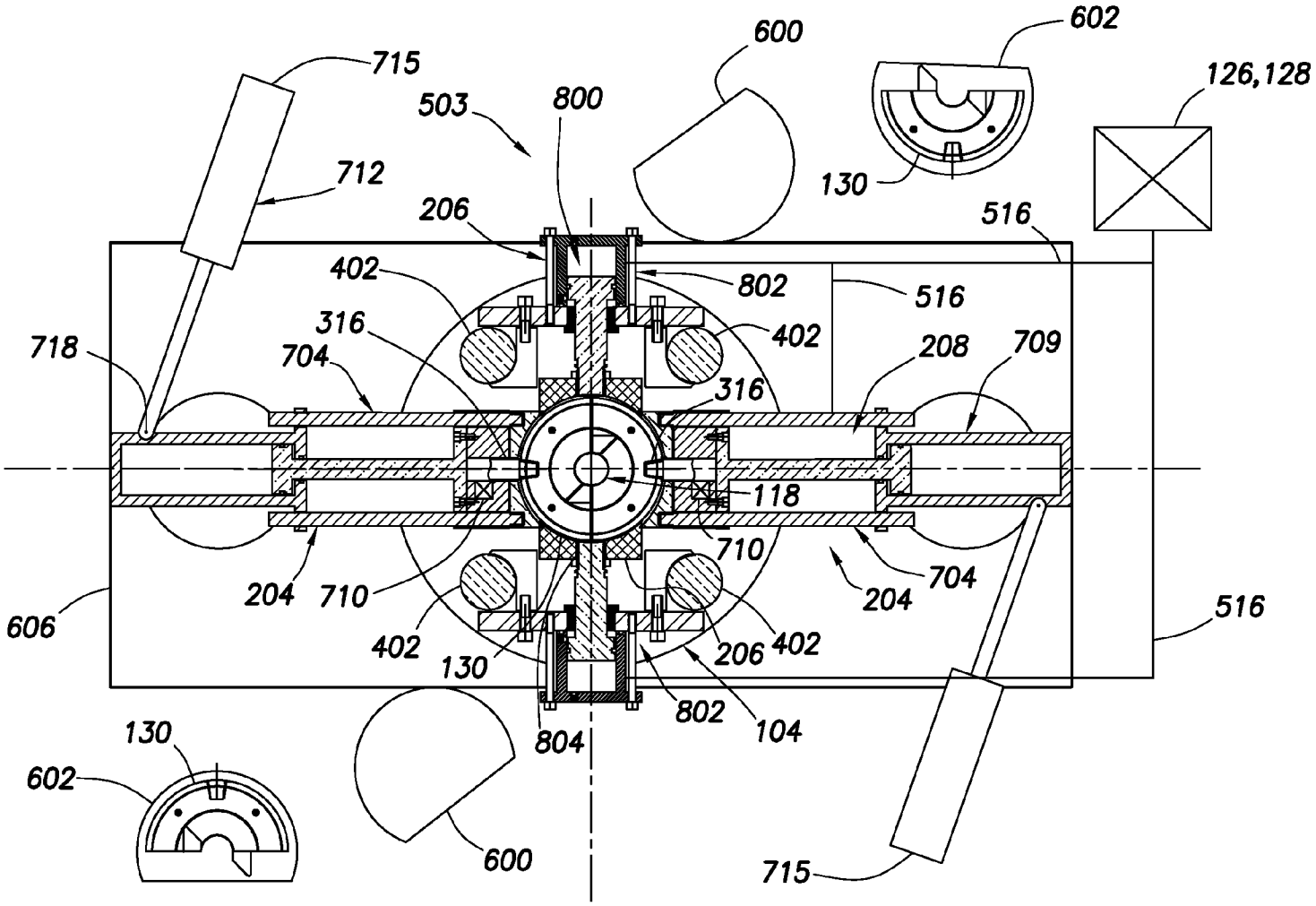
FIG. 8-16 show top views of an equipment replacement system depicting the operation thereof.

The system may also include the hydraulic system, or a plurality of hydraulic operators which drive or move the one or more seal holders 206, one or more the replacement arms 204, and/or control the operation of the door 200, or door assembly, (as shown in FIG. 5). FIG. 8 shows each of the one or more seal holders 206 being operated by a seal holder actuator 800. The seal holder actuator 800 may be a piston and cylinder actuator having a fixed end 802 coupled to the stripper 104, the one or more stripper retaining bolts 402 and/or the seal assembly replacement system 132 and a motive end 804. As the piston and cylinder are moved, the motive end 804 moves the seal holder 206 into and out of engagement with the seal assembly 130. The seal holder actuator 800 may operate in a similar manner any of the actuators described herein.

To replace a worn pair of seal assembly 130 halves (or packer halves) with new ones, a pair of diametrically rotary transfer arms may be mounted on either side of the stripper 104, or the stripper/packer, which are rotationally driven by their respective arm actuators 208, or hydraulic rotary indexer. Each seal replacement arm 204 (or rotary transfer arm) may include the arm piston actuator 709 as shown in FIGS. 7A-7C, or an axial drive piston which drives axial movement of the engager 316 (or the threaded male probe). The engager 316 (or the probe) may be rotationally driven by the hydraulic motor (or the engager actuator) to turn the probe. The receiver 314 (or the mating threaded female receiver) may be provided in each of the seal assemblies 130 (or the packer assembly) to receiver and mate with the engager 316 (or the probe). While the threaded coupling of the engager 316 (or the probe) and the receiver 314 (or the female receiver) are preferred, other means of coupling the replacement arm 204 (or the transfer arm) and the seal assembly 130 (or the packer assembly) may be used.

In operation, each of the engagers 316 (or probes) may engage each of the receivers 314 for the seal assembly 130 halves. Then the arm piston actuators 709 (or axial drive piston) are pulled back, removing both of the worn seal assembly 130 halves (or worn packer halves) from the stripper 104 (or stripper/packer). The seal replacement arm 204 (or transfer arm) may then be rotated to align the worn seal assembly 130 half (or packer half) with the used packer bin 600 where the engager 316 (or probe) will rotate to uncouple the engager 316 (or probe) from the worn seal assembly 130 half (or packer half). Then, the replacement arm 204 (or the transfer arm) rotates to align with a new packer bin 602. The engager 316 (or probe) may then rotate to engage a new seal assembly 130 half (or new packer half) from the new packer bin 602. The new seal assembly 130 may then be moved into the stripper 104 (or stripper/packer) by rotating the seal replacement arm 204 (or the transfer arm) back into alignment with the open door 200.

The removal and replacement of the seal assembly 130 will now be described in conjunction with FIGS. 8-16 which represent a top view of the seal assembly portion 503 of the stripper 104, as shown in FIG. 5. These figures depict the stripper performing an example of a replacement operation in sequence. The apparatus may be actuated to perform the operation using, for example, the controllers 126, 128 (FIG. 1).

FIG. 8 shows the door 200 (as shown in FIG. 2A) has been opened thereby allowing access to the seal assembly 130. As the door 200 opens, the one or more seal holders 206 may be actuated into engagement with the seal assembly 130 in order to prevent the seal assembly 130 from inadvertently falling out of the stripper 104. As shown there are two seal holders 206 configured to hold the seal assembly 130, although it should be appreciated that there may be any number of seal holders 130. In one example, there are two seal holders 130 located on opposite sides of the seal assembly 130. The one or more seal holders 206 (or grippers) are shown in FIG. 8 holding the seal assembly 130 (or the packer assembly 130 halves which may also be referred to herein as "carriers") in position while the engager 316 (or the probe) is engaging the receiver 314 (or the female thread) in the carrier. The seal holders 206 (or the grippers) retain the carrier halves (or the seal assembly 130 halves) in position to permit the mating of the engager 316 (or the probe) and the receiver 314 (or the threaded female receiver).

In order to engage the seal assembly 130 with the engager 316, the one or more arm piston actuators 709 for each of the seal replacement arms 204 may be actuated into engagement with the seal assembly 130 halves. The engager actuator 710 may be actuated to couple or connect the engager 316 to the receiver 314. FIG. 8 shows the engager 316 engaged with the receiver 314 and the seal replacement arms 204 ready to remove the worn seal assembly 130 from the stripper 104.

Figure 9:
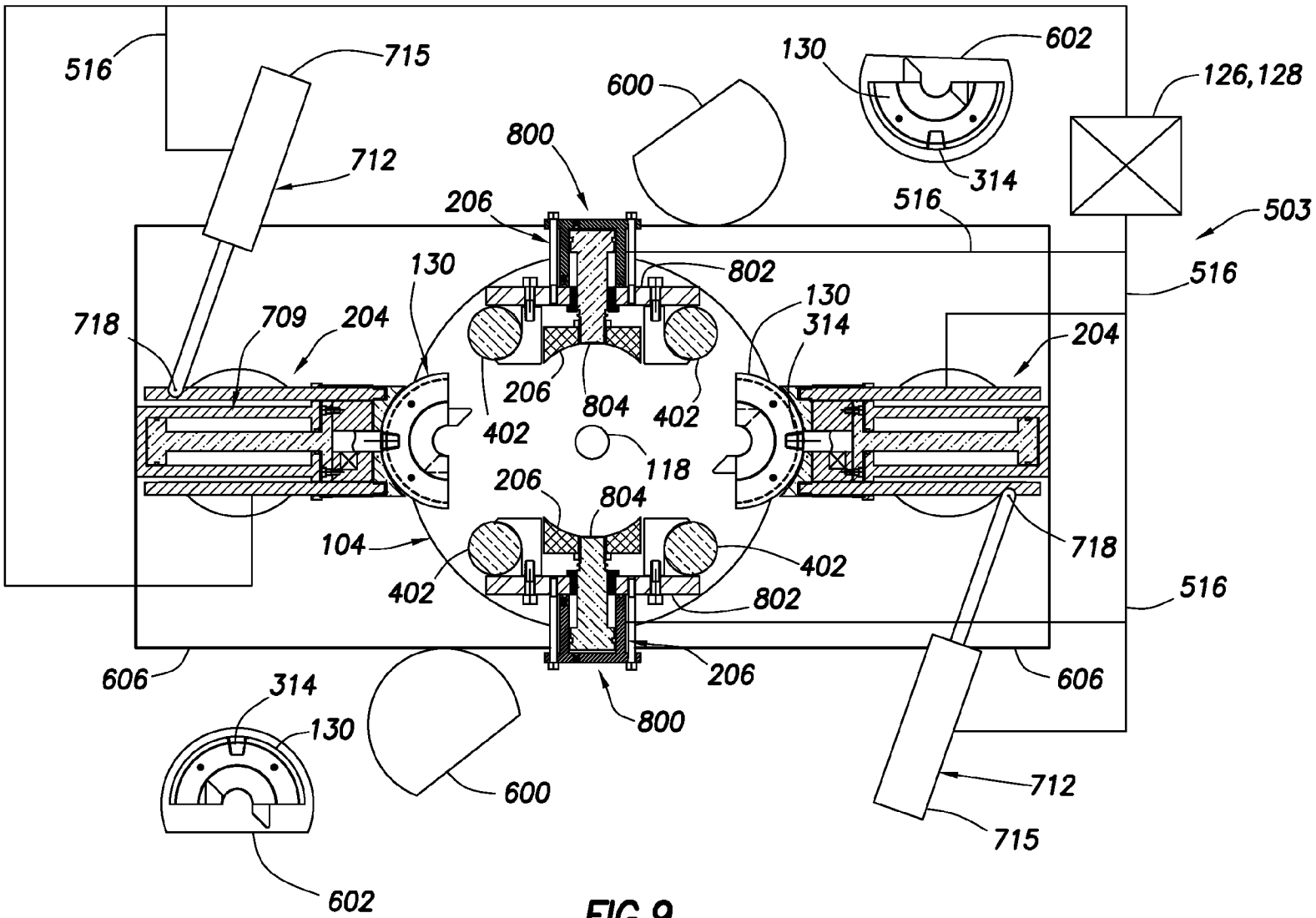

FIG. 9 shows the seal assembly 130 halves (or carrier halves) withdrawn from the stripper 104 (or stripper/packer). Note also that the seal holders 206 (or grippers) are pulled back to permit removal of the seal assembly 130 (or carrier) halves. This would also be the position if it were desirable to pass a larger diameter tool through the stripper 104 (or the stripper/packer). To withdraw the seal assembly 130 halves, the seal holder actuators 800 for each of the seal holders 206 engaged with the seal assembly 130 halves may be actuated. The seal holder actuators 800 may move the motive end 804 thereby disengaging the seal holders 206 from the seal assembly 130 halves. In this position the seal assembly 130 halves may be removed from the stripper 104 without obstruction. The arm piston actuator 709 may be actuated to pull the seal replacement arm 204 to the retracted position as shown in FIG. 9.

Figure 10:
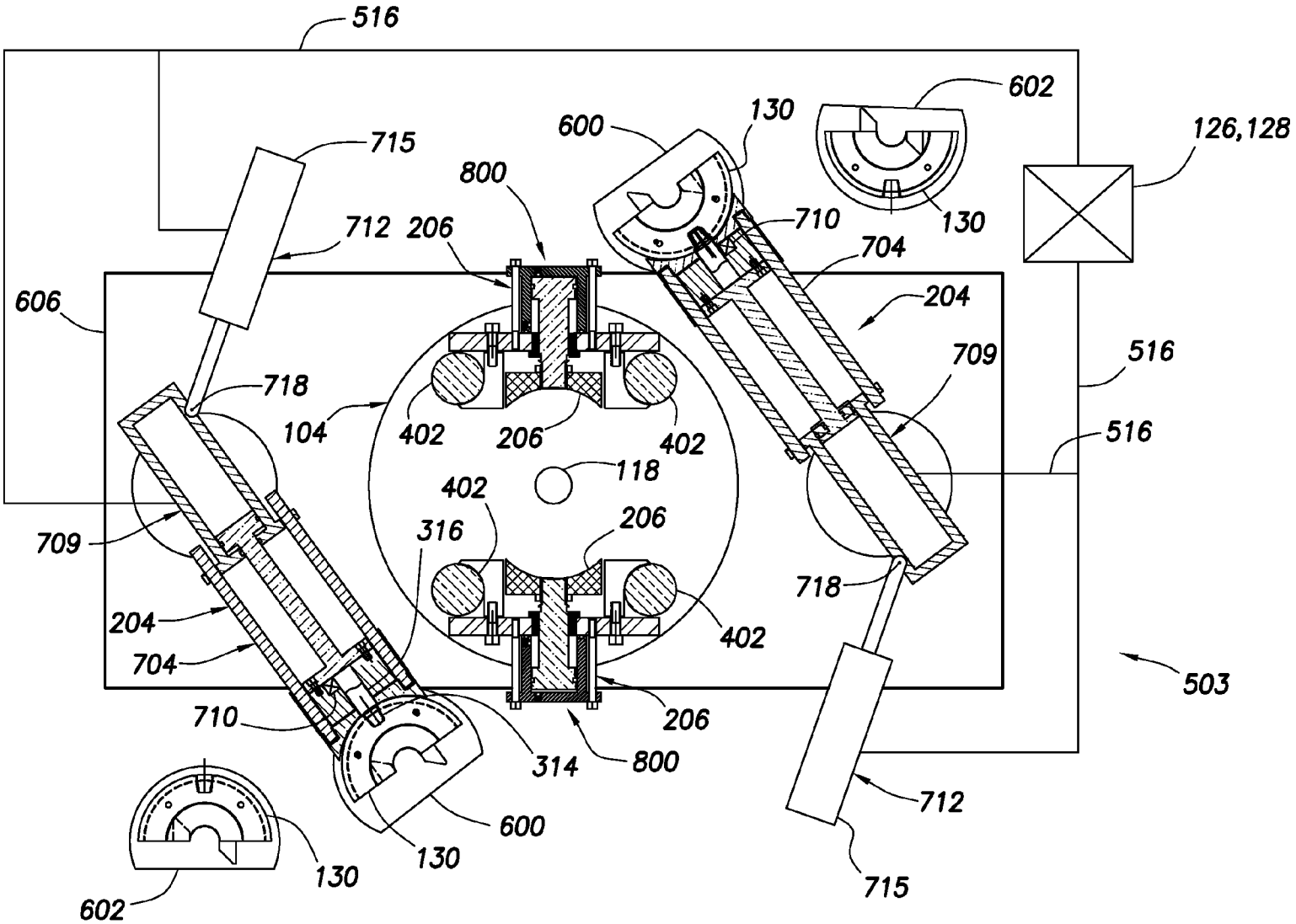

FIG. 10 shows the seal replacement arms 204 disposing of the used seal assembly 130 halves in the used packer bins 600. The seal replacement arms 204 may be rotated into this position by actuating the arm rotation actuators 712 of each of the respective seal replacement arms 204. Once rotationally aligned with the used packer bins 600 it may be necessary to extend the seal replacement arms 204 in order to reach the used packer bins 600. The seal replacement arm 204 (or transfer arms index) may then extend to release the seal assemblies 130 (or carriers) into the used packer bins 600 by rotating engagers 316 (or the probes) and disengaging from the receivers 314 (or the female receivers). The seal replacement arms 204 may be extended by actuating the arm piston actuator 709 until the seal assembly 130 half is proximate the used packer bin 600. With the seal assembly 130 half proximate the used packer bin 600, the engager actuator 710 may be actuated to disconnect the engager 316 from the receiver 314. The used seal assembly 130 half may then fall into the used packer bin 600.

Figure 11:
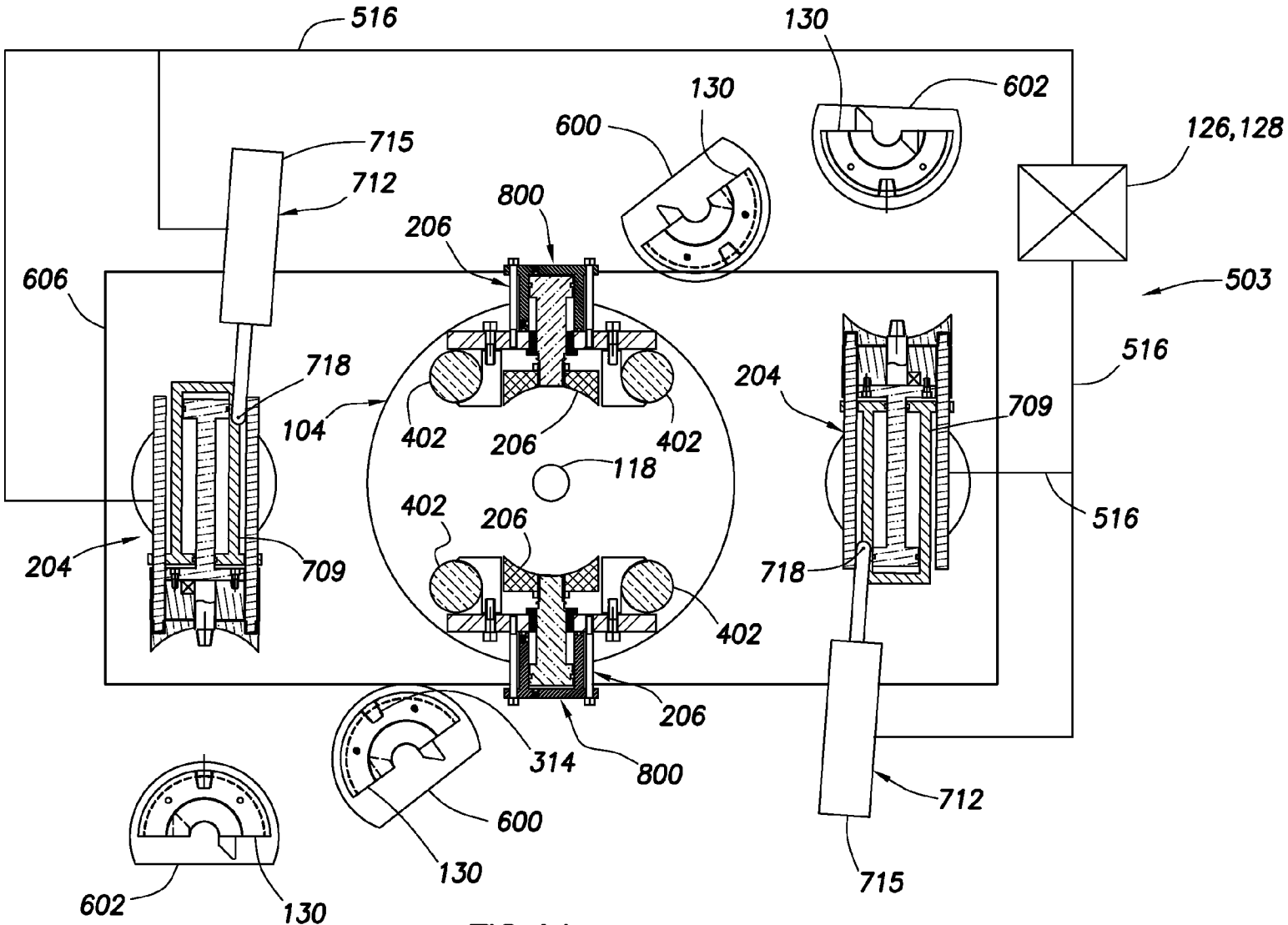

With the used seal assembly 130 disposed of, the seal replacement arms 204 are free to grab the new seal assembly 130. The seal replacement arms 204 may simply rotate into alignment with the new packer bin 602, or may need to be retracted then rotated into alignment with the new packer bin 602. FIG. 11 shows the seal replacement arms 204, or the transfer arms, in a retracted position and indexed to align with the new bins, or the new packer bin 602. To reach this position, the arm piston actuator 709 may be actuated to retract the seal replacement arms 204 axially. The arm rotation actuators 712 may be actuated until the seal replacement arms 204 are in alignment with the new packer bin 602.

Figure 12:
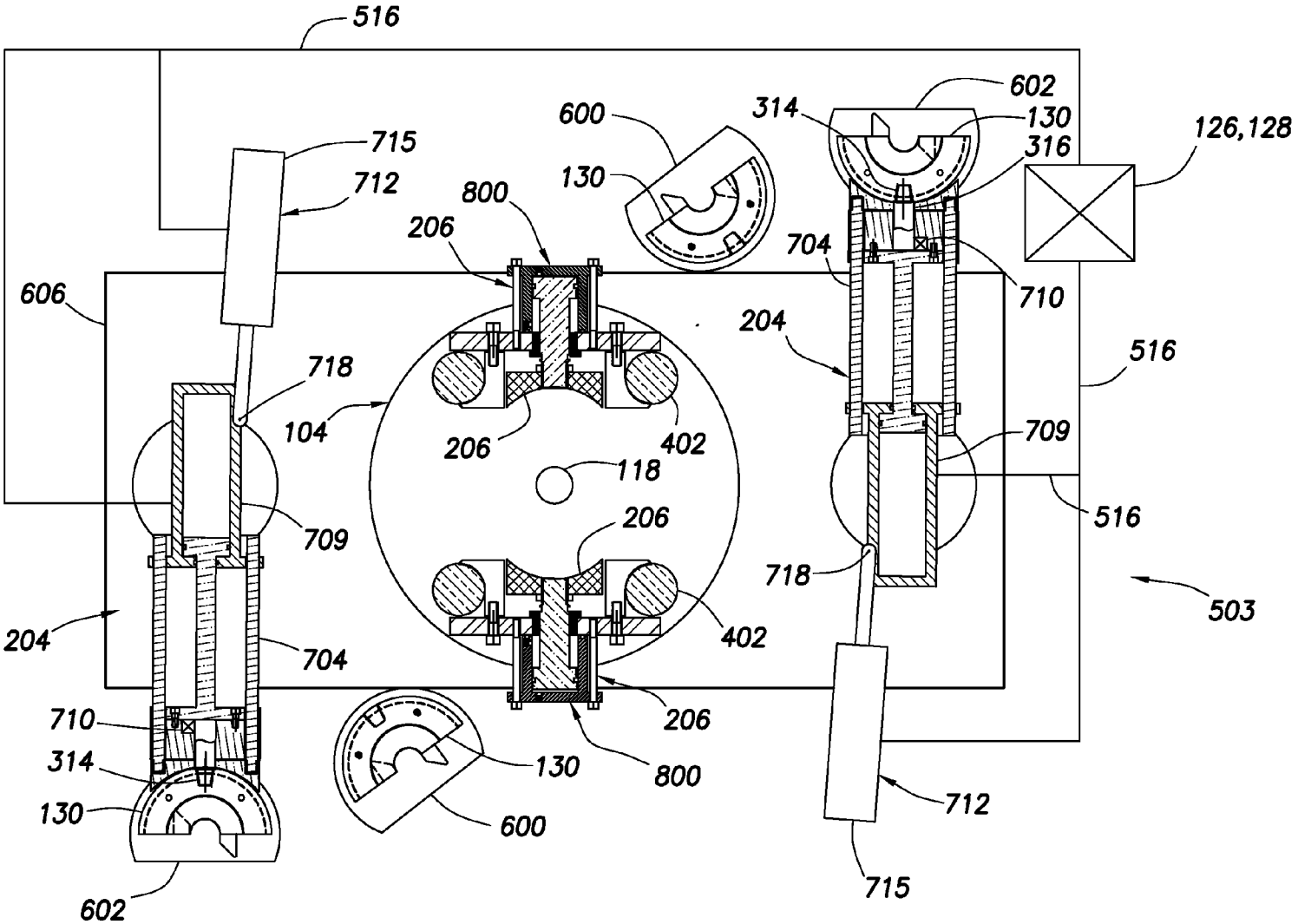
Figure 13:
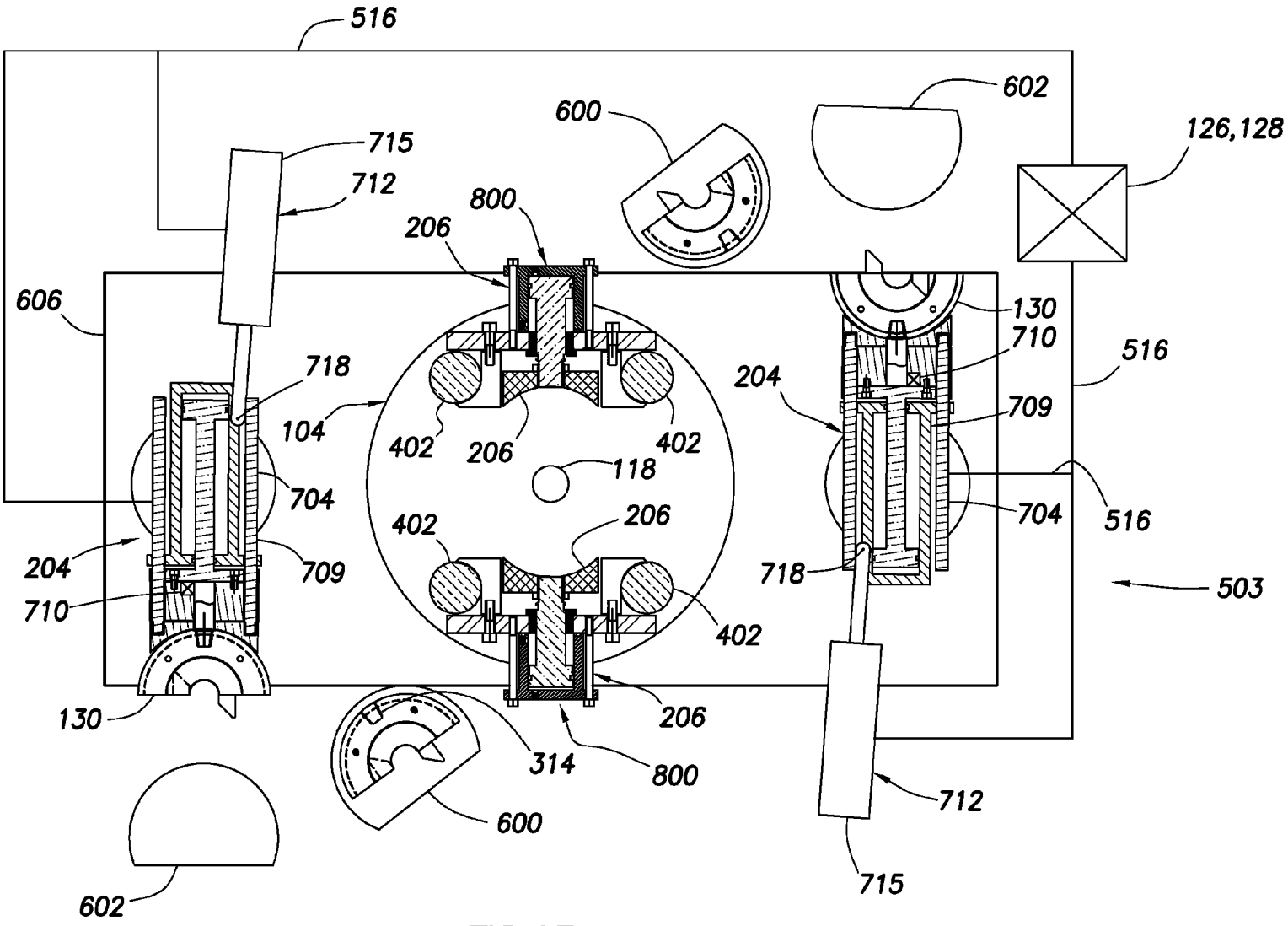

FIG. 12 shows the seal replacement arms 204 engaged with the new seal assembly 130. To engage the new seal assembly 130, the seal replacement arms 204 (or the probe) extend to engage the new seal assembly 130 half (or a new carrier) in the new packer bin 602. The seal replacement arms 204 may be extended by actuating the arm piston actuator 709 until the engager 316 engages the receiver 314. The engager actuator 710 may be actuated to engage the receiver 314 with the engager 316. The new seal assembly 130 half may then be removed from the new packer bin 602. To remove the seal assembly 130 half, the seal replacement arms 204 (or the changer) retract thereby pulling the new seal assembly 130 halves (or new carrier halves) from the new packer bins 602. The seal replacement arms 204 may be retracted by actuating the arm piston actuators 709. FIG. 13 shows the seal assembly 130 halves removed from the new packer bin 602.

Figure 14:
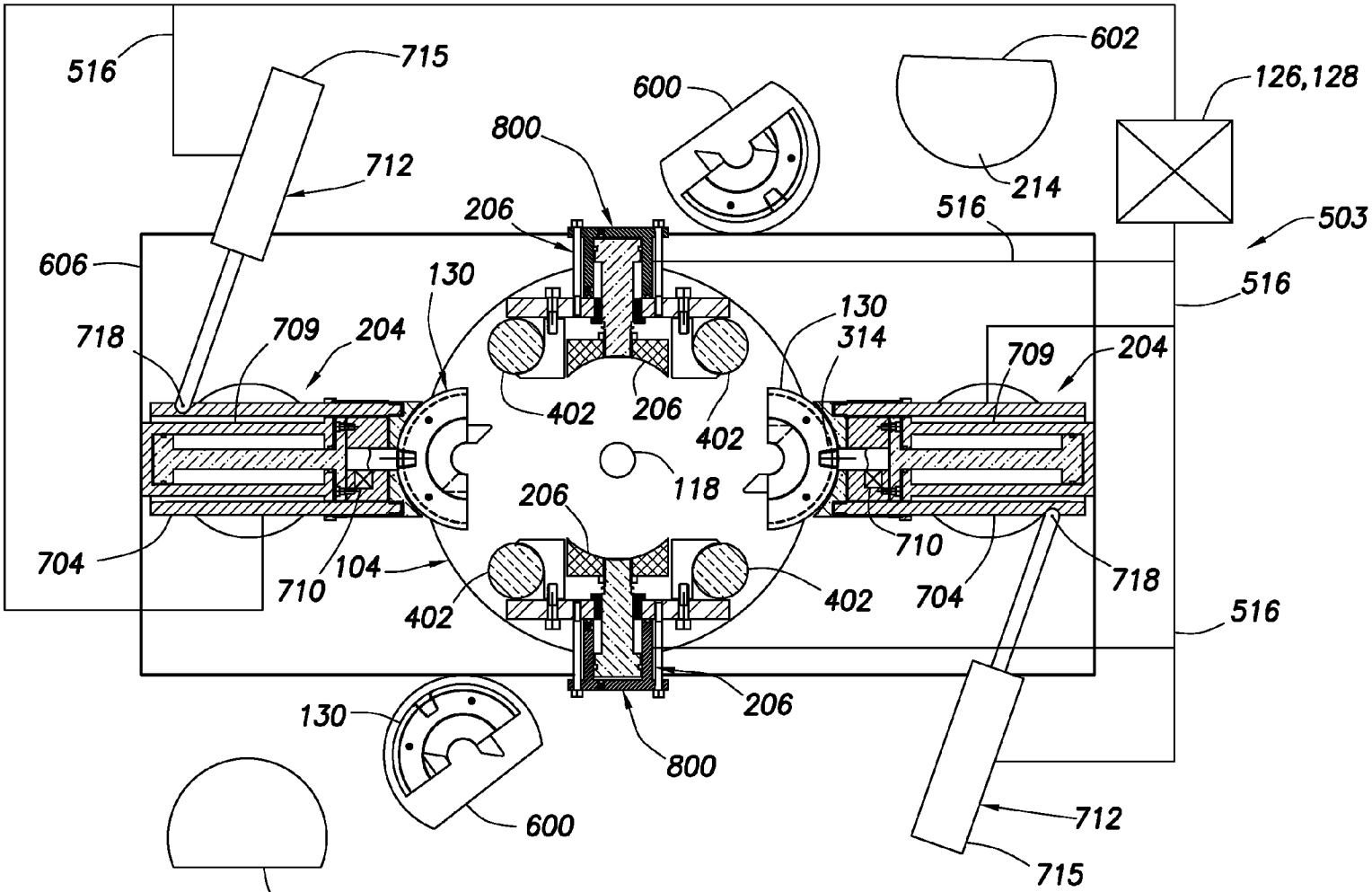

FIG. 14 shows the seal replacement arms 204 (or the transfer arms) indexed to align with the stripper 104 (or the stripper/packer). The arm rotation actuators 712 may be actuated in order to align the seal replacement arms 204 with the stripper 104. The stripper 104 may still have the door 200 (as shown in FIG. 2A) in the open position thereby allowing the seal assembly 130 halves to be moved into the stripper 104. If the door 200 is closed, the door 200 may be opened prior to reinstalling the seal assembly 130 halves.

Figure 15:
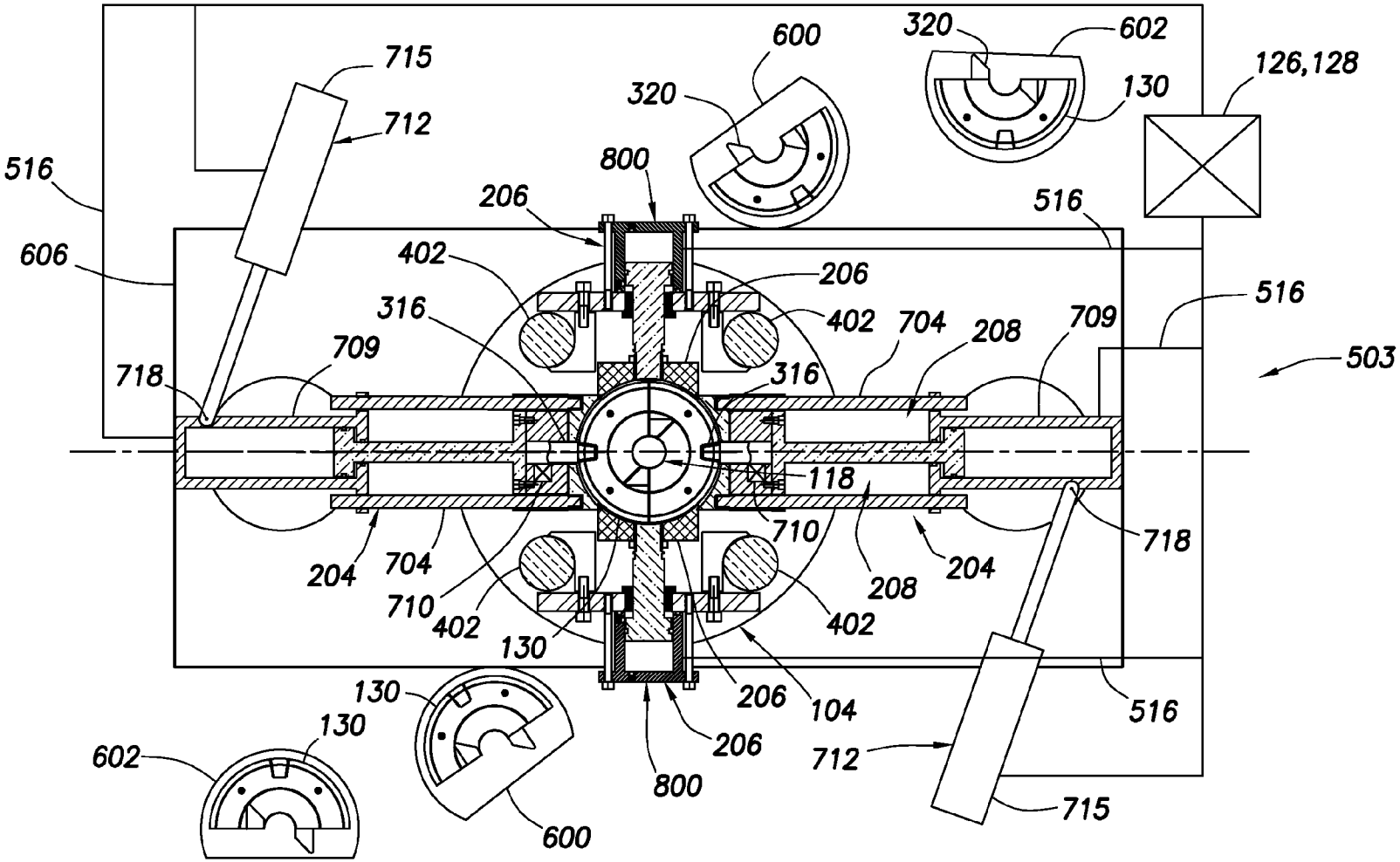

FIG. 15 shows the seal replacement arms 204 (or the changer) extended with the new seal assembly 130 halves (or the new packer) and the seal holders 206 (or the grippers) closed, securing the seal assembly 130 (or the packer) in place. The arm piston actuator 709 may be actuated to extend the seal assembly 130 halves toward one another and into the stripper 104. As the seal assembly 130 halves engage one another, the opposing exterior guides 320 and the interior guide 322 align the seal assembly 130 halves into alignment with one another. As the seal replacement arm 204 continues to extend the mating edge 324 (as shown in FIGS. 3J and 3O) of the packer 308 and the seal 310 mate to form a seal between the seal assembly 130 halves. With the seal assembly 130 halves mated together, the seal holders 206 may be actuated to engage the seal assembly 130 prior to releasing the seal replacement arms 204. The engager actuator 710 may be actuated to release the engager 316 from the receiver 314.

Figure 16:
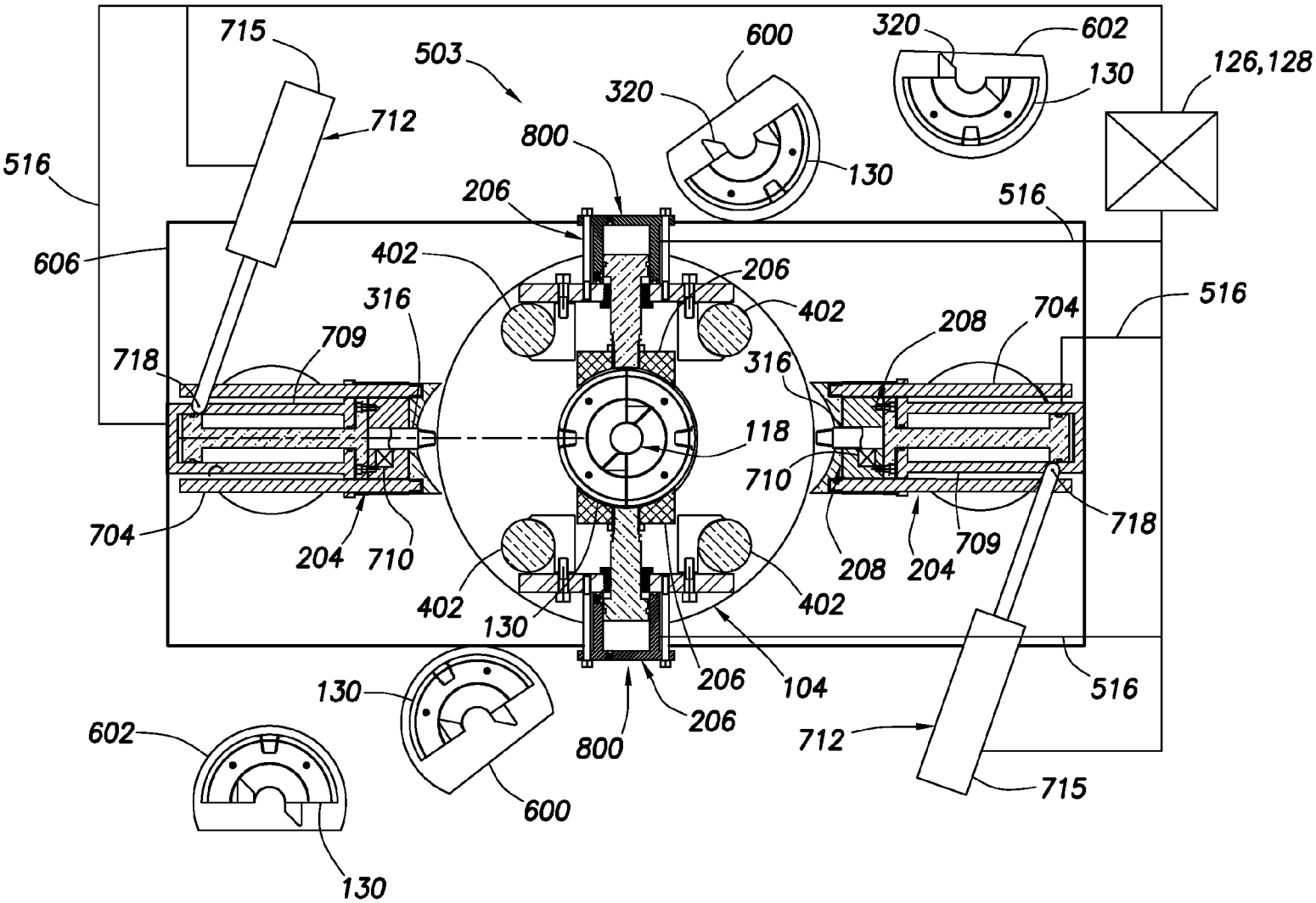

The seal replacement arm 204 (or the changer) may then disengage the seal assembly 130 as shown in FIG. 16. The arm piston actuator 709 may be actuated to disengage the seal replacement arm 204 from the seal assembly 130. The door 200 (or the side door) (as shown in FIG. 2A) may start closing, the grippers 206 may open, the side door 200 completes the closing, and the door stops closed. As the door 200 closes, the door 200 may secure the seal assembly 130 within the stripper 104 thereby allowing the one or more seal holders 206 to disengage the seal assembly 130. The one or more seal holders 206 (or the grippers) may not be at the full height of the carrier; they may engage the seal assembly 130 from the receiver 314, or the engagement thread down and/or up depending on the door 200 configuration, in order for the door 200 (or the side door stop) to secure the position of the carrier before the seal holders 206 (or the grippers) release.

With the seal assembly 130 in the stripper 104 and the door 200 in the operating or closed position, the seal actuator 202 (as shown in FIGS. 2A, 2B and 5) may actuate the seal assembly 130 into sealing engagement with the conveyance 118. The conveyance 118 may then be run into and/or out of the stripper 104 without losing pressure upstream and/or downstream of the seal assembly 130.

Although the seal assembly replacement system 132 is described as being used to replace the seal assembly 130 in a stripper 104 while the stripper 104 is proximate the wellhead, the equipment replacement system 102 may be used to run larger downhole tools 114 (as shown in FIG. 1) through the stripper 104. As shown herein, the conveyance 118 may move the downhole tool 114 proximate the stripper 104. One of the seal assemblies 130 may be removed from the stripper 104 in a similar manner as described above, although rotating the seal replacement arms 204 (as shown in FIG. 12) may not be necessary. With the seal assembly removed the conveyance 118 may pull the downhole tool 114 past the empty seal portion 503 (as shown in FIG. 5). Once the downhole tool 114 is past the empty seal portion 503, the seal assembly 130 may be replaced and secured back into the stripper 104 in a similar manner as described above. This method may be repeated at the subsequent seal portions 503 until the downhole tool 114 is out of the stripper 104.

Figure 17:
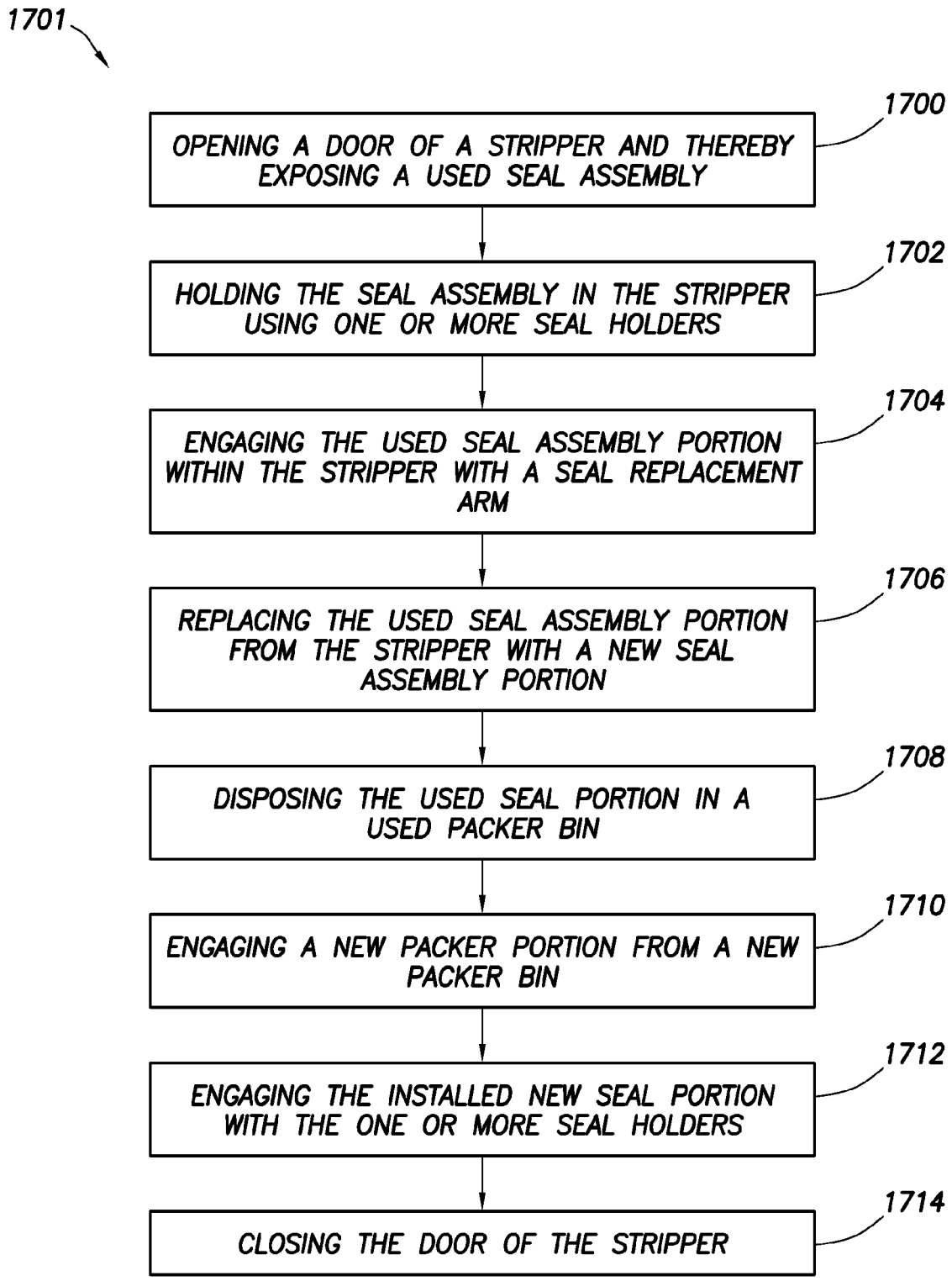
FIG. 17 is a flow chart illustrating a method for replacing a seal assembly in a stripper as shown in FIG. 1.

FIG. 17 is a flowchart depicting a method 1701 of replacing equipment at a wellsite. The equipment may be, for example, a packer positionable in a stripper of the wellsite. The method 1701 comprises opening 1700 a door of the stripper and thereby exposing a used seal assembly contained therein. The method 1701 may optionally comprise holding 1702 the used seal assembly in the stripper using one or more seal holders. The method 1701 further comprises engaging 1704 the used seal assembly portion within the stripper with a seal replacement arm operatively coupled to the subsea stripper and replacing 1706 the used seal assembly portion from the stripper with a seal replacement arm. The at least one seal replacement arm may be remotely actuated. The method 1701 may further comprise disposing 1708 the used seal assembly in a used packer bin and engaging 1710 a new seal assembly from a new packer bin. The method 1701 may further comprise engaging 1712 the installed new seal assembly portion with the one or more seal holders. The method 1701 may further comprise closing 1714 the door of the stripper.

An example of a replacement operation is provided. In order to replace a worn packer, release the door stop, and apply hydraulic pressure to open the door (e.g., 200 of FIG. 2A). Next, remove the halves of the packer (e.g., seal assembly 130). Remove the upperwear bushing, and lower wear bushing (e.g., bushings 306 of FIG. 3A and/or packer bushings 400 of FIG. 4A). Each of these elements (e.g., seal assemblies 130) is split along the vertical axis in order that they can be removed, and/or installed with the coiled tubing in place. This procedure may work well in atmosphere friendly to humans, but with the present invention can be accomplished in an environment unfriendly to humans, such as deep subsea.

To make it possible to remotely change wellsite equipment, such as packers, this invention may include all of the pieces of the packer and bushings in the carrier (e.g., as seal assembly 130). The carrier may be a metal and can split along the vertical axis, with a female thread, preferable with a tapered thread profile to facilitate engagement (see, e.g., seal assembly 130 of FIGS. 3A-3P).

The first step in the sequence of operation may involve opening the side door stop, followed by opening the side door (e.g., door 200 of FIGS. 2A and 5). Once the side door is open, the grippers (e.g., seal holders 206) may then be closed, in order to secure the position of the carrier. Next, hydraulic pressure may extend to the hydraulic motor, with a matching male thread to engagement with the female receiver (see, e.g., 314 and 316 of FIGS. 3A-3P). Activating the hydraulic motor screws the male thread (e.g., engager 314 of FIG. 3C) into the carrier. The torque arms may hold the hydraulic motor, and the semi-circular guide (e.g. a seal assembly guide portion 706 of FIG. 7A) that maintains the position of the hydraulic motor to the carrier. Then, the grippers may then be opened.

Hydraulic pressure may then applied in the change cylinder to retract the changer with its half of the carrier. The changer can now be indexed to a position to deposit the carrier with the worn packer in the used bin. Next, the changer is retracted, indexed, extended, and operated to engage with a new carrier from the new bin (see, e.g., new packer bin 602 of FIG. 13). The changer may once more be retracted.

Now the changer can be indexed to align with the stripper, and extended to position the carrier into the stripper. The grippers are closed to hold the carrier in place, the side door is partially closed, but not so far as to contact the changer. The changer is disengaged from the carrier, and retracted. The grippers are then opened, the side door closure completed, and the side door stop closed, to prevent unintentional opening of the side door. All of the above operations would occur simultaneously with both halves of the Carrier.

While the present disclosure describes specific aspects of the invention, numerous modifications and variations will become apparent to those skilled in the art after studying the disclosure, including use of equivalent functional and/or structural substitutes for elements described herein. For example, aspects of the invention can also be implemented for operation in combination with other known stripper and packer systems. All such similar variations apparent to those skilled in the art are deemed to be within the scope of the invention as defined by the appended claims.

While the embodiments are described with reference to various implementations and exploitations, it will be understood that these embodiments are illustrative and that the scope of the inventive subject matter is not limited to them. Many variations, modifications, additions and improvements are possible.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A replaceable seal assembly for a stripper at a wellsite, the wellsite having a tubing extending through a blowout preventer and into a borehole, the seal assembly comprising:

a carrier divided along a longitudinal axis thereof into at least two longitudinal carrier portions, the carrier operatively connectable to the stripper;

a packer positionable in each of the at least two longitudinal carrier portions and extendable therefrom to sealingly engage the tubing; and a pair of bushings positionable in each of the at least two longitudinal carrier portions, the pair of bushings comprising an upper and a lower bushing positionable on opposite sides of the packer to support to the packer therein, each of the pair of bushings comprising an exterior guide and an interior guide, the exterior guide matingly connectable with the interior guide of another of the at least two longitudinal carrier portions.

2. The seal assembly of claim 1, wherein the carrier has a receiver on an outer surface thereof.

3. The seal assembly of claim 1, further comprising at least one extrusion ring.

4. The seal assembly of claim 1, further comprising at least one retaining member comprising at least one retaining bolt operatively connectable to the packer and the at least one bushing.

5. The seal assembly of claim 1, wherein the at least two longitudinal carrier portions comprise two longitudinal, hemi-cylindrical portions.

6. The method of claim 1, further comprising a seal positionable about the carrier and one of the pair of bushings.

7. A system for replacing a seal assembly for a stripper at a wellsite, the wellsite having a tubing extending through a blowout preventer and into a borehole, the system comprising:

at least one seal assembly positionable in the stripper and replaceable therefrom, the at least one seal assembly comprising:

a carrier divided along a longitudinal axis thereof into at least two longitudinal carrier portions, the carrier operatively connectable to the stripper;

a packer positionable in each of the at least two longitudinal carrier portions and extendable sealingly engage the tubing; and at least one bushing positionable in each of the at least two longitudinal carrier portions adjacent the packer to support to the packer therein, each of the at least one bushings comprising an exterior guide and an interior guide, the exterior guide matingly connectable with the interior guide of another of the at least two longitudinal carrier portions; and a seal assembly portion comprising:

a platform operatively connected to the stripper, the platform having a hole for receiving the tubing therethrough;

at least one seal replacement arm comprising a piston selectively extendable therefrom, the at least one seal replacement arm supportable on the platform; and an actuator operatively connectable to the at least one seal replacement arm to remotely actuate the at least one seal replacement arm to engage the at least one seal assembly whereby the at least one seal assembly is remotely replaceable.

8. The system of claim 7, wherein the at least one seal assembly comprises a plurality of the replaceable seal assemblies.

9. The system of claim 8, wherein the at least one seal assembly comprises a plurality of bushings, each of the plurality of bushings having at least one guide to facilitate mating of a plurality of the at least one seal assemblies.

10. The system of claim 7, further comprising a new packer bin accessible by the at least one seal replacement arm for housing the at least one seal assembly prior to use in the stripper.

11. The system of claim 7, further comprising a used packer bin accessible by the at least one seal replacement arm for disposal of the at least one seal assembly after use in the stripper.

12. The system of claim 7, further comprising at least one seal holder configured to secure the at least one seal assembly in an installed position in the stripper while the door is in an open position.

13. The system of claim 7, wherein the at least one seal replacement arm further comprises an engager operatively connectable to a receiver of the at least one seal assembly.

14. A method for replacing a seal assembly of a stripper at a wellsite, the wellsite having a tubing extending through a blowout preventer and into a borehole, the method comprising:

opening a door of the stripper, the stripper operatively connectable to a seal assembly portion, the seal assembly portion comprising a platform having a hole for receiving the tubing and at least one seal replacement arm supported on the platform;

engaging a used seal assembly within the stripper by remotely actuating the at least one seal replacement arm;

removing the used seal assembly by retracting the at least one seal replacement arm;

replacing the used seal assembly from the stripper by positioning a new seal assembly in the stripper using the remotely actuated at least one seal replacement arm to extend the new seal assembly into the stripper, the new seal assembly comprising a carrier divided along a longitudinal axis thereof into at least two longitudinal carrier portions, a packer and at least one bushing positionable in each of the at least two longitudinal carrier portions, each of the at least one bushing comprising an interior guide and an exterior guide;

matingly connecting the interior and exterior guides of each of the at least two longitudinal carrier portions with the interior and exterior guides of another of the at least two longitudinal carrier portions; and closing the door of the stripper.

15. The method of claim 14, wherein engaging the used seal assembly further comprises remotely actuating an engager connected to the at least one seal replacement arm into engagement with a receiver of the used seal assembly.

16. The method of claim 14, further comprising disposing the used seal assembly in a used packer bin.

17. The method of claim 14, further comprising removing the new seal assembly from a new packer bin using the at least one seal replacement arm.

18. The method of claim 14, further comprising holding the new seal assembly in the stripper with a seal holder prior to the closing of the door.

* * * * *